US007142176B2

(12) United States Patent
Shiizaki et al.

(10) Patent No.: US 7,142,176 B2
(45) Date of Patent: Nov. 28, 2006

(54) METHOD OF DRIVING PLASMA DISPLAY PANEL

(75) Inventors: Takashi Shiizaki, Kawasaki (JP); Hitoshi Hirakawa, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 330 days.

(21) Appl. No.: 10/873,618

(22) Filed: Jun. 23, 2004

(65) Prior Publication Data

US 2005/0052353 A1 Mar. 10, 2005

Related U.S. Application Data

(63) Continuation of application No. 09/986,922, filed on Nov. 13, 2001, now abandoned.

(30) Foreign Application Priority Data

Jun. 19, 2001 (JP) ..... 2001-185387

(51) Int. Cl.
*G09G 3/28* (2006.01)
*G09G 3/10* (2006.01)

(52) U.S. Cl. ..... 345/63; 345/66; 345/67; 345/213; 345/690; 315/169.1; 315/169.2; 315/169.3; 315/169.4

(58) Field of Classification Search ..... 345/60–68, 345/205–214, 690; 315/169.1, 169–4; 313/581, 313/585

See application file for complete search history.

(56) References Cited

U.S. PATENT DOCUMENTS

| | | | | |
|---|---|---|---|---|
| 6,084,558 | A | 7/2000 | Setoguchi et al. | |
| 6,531,994 | B1 * | 3/2003 | Nagano | 345/60 |
| 6,531,995 | B1 | 3/2003 | Ishii et al. | |
| 6,667,728 | B1 | 12/2003 | Kanazawa et al. | |
| 6,731,255 | B1 * | 5/2004 | Van Leeuwen et al. | 345/60 |

FOREIGN PATENT DOCUMENTS

| | | |
|---|---|---|
| JP | 2000-181402 | 6/2000 |
| JP | 2001-147660 | 5/2001 |
| JP | 2002-14648 | 1/2002 |
| JP | 2002-366077 | 12/2002 |

* cited by examiner

*Primary Examiner*—Henry N. Tran
(74) *Attorney, Agent, or Firm*—Staas & Halsey LLP

(57) ABSTRACT

A method of driving a plasma display panel, which includes controlling a charge state of a first display line being one of the two adjacent display lines utilizing the same single scan electrode, such that address discharge is not generated and controlling a charge state of a second display line being the other of the two adjacent display lines, such that address discharge can be generated, and then generating address discharge in the second display line, controlling the charge state of the second display line such that address discharge is not generated and controlling the charge state of the first display line such that the address discharge can be generated, and then generating address discharge in the first display line, and generating surface discharge simultaneously in the first and second display lines, thereby to achieve progressive display.

20 Claims, 14 Drawing Sheets

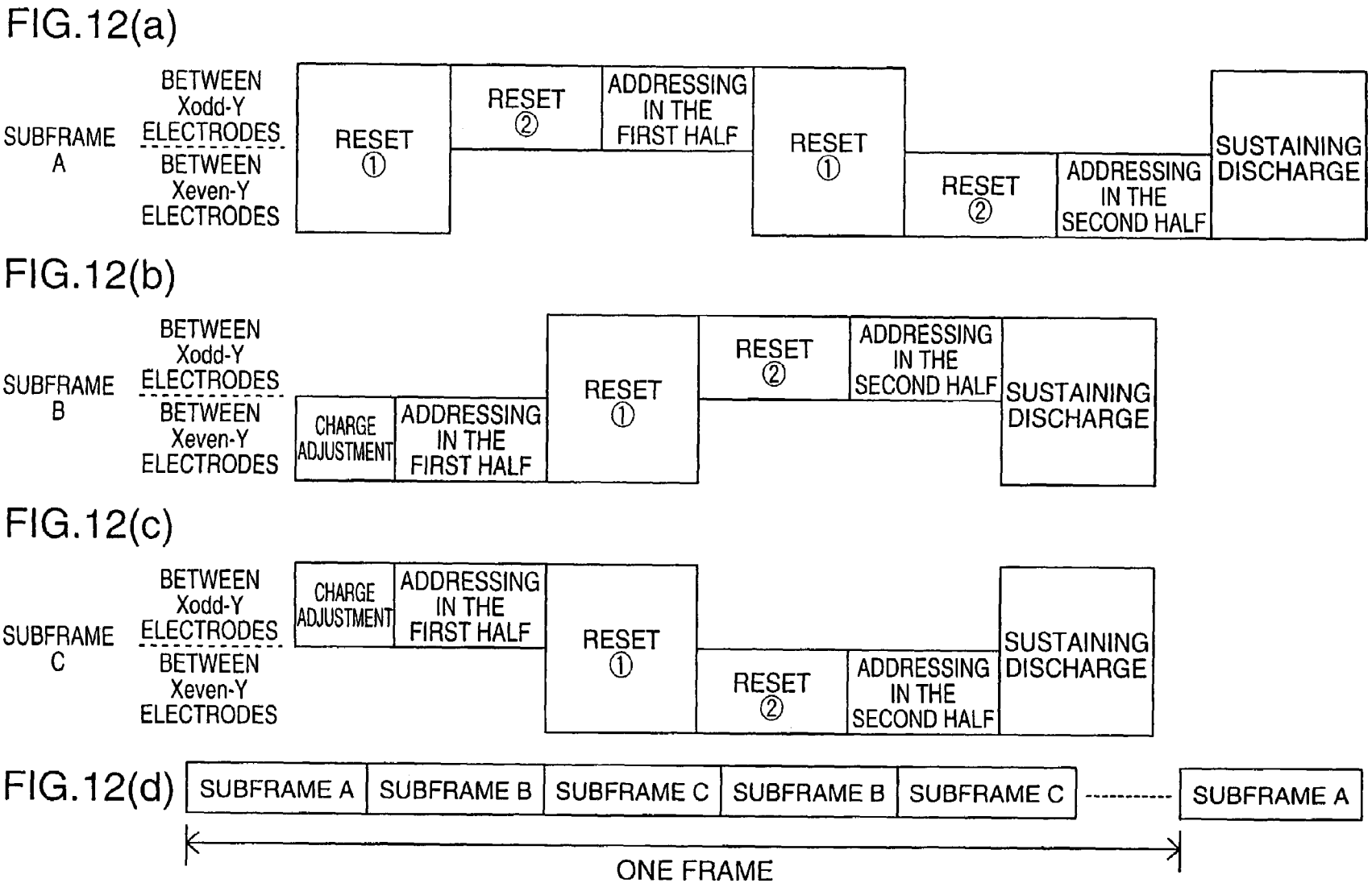
FIG.12(a)
SUBFRAME A
BETWEEN Xodd-Y ELECTRODES
BETWEEN Xeven-Y ELECTRODES
RESET ①
RESET ②
ADDRESSING IN THE FIRST HALF
RESET ①
RESET ②
ADDRESSING IN THE SECOND HALF
SUSTAINING DISCHARGE
FIG.12(b)
SUBFRAME B
BETWEEN Xodd-Y ELECTRODES
BETWEEN Xeven-Y ELECTRODES
CHARGE ADJUSTMENT
ADDRESSING IN THE FIRST HALF
RESET ①
RESET ②
ADDRESSING IN THE SECOND HALF
SUSTAINING DISCHARGE
FIG.12(c)
SUBFRAME C
BETWEEN Xodd-Y ELECTRODES
BETWEEN Xeven-Y ELECTRODES
CHARGE ADJUSTMENT
ADDRESSING IN THE FIRST HALF
RESET ①
RESET ②
ADDRESSING IN THE SECOND HALF
SUSTAINING DISCHARGE
FIG.12(d)
SUBFRAME A
SUBFRAME B
SUBFRAME C
SUBFRAME B
SUBFRAME C
SUBFRAME A
ONE FRAME FIG.15(a)
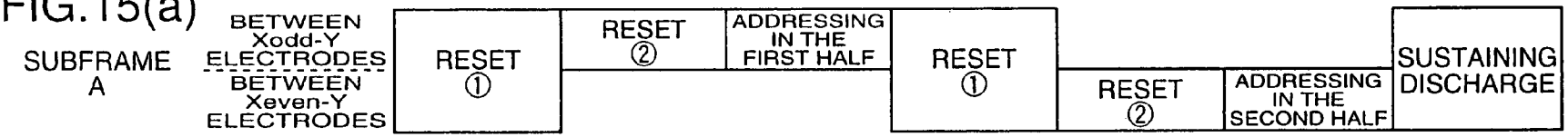
FIG.15(b)
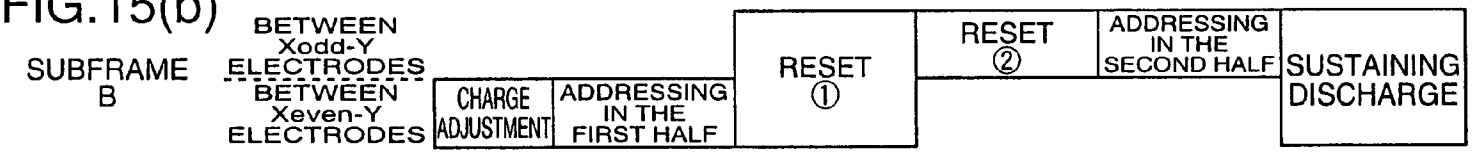
FIG.15(c)
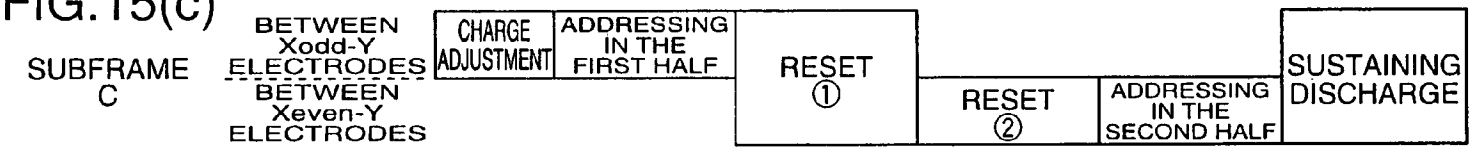
FIG.15(d)
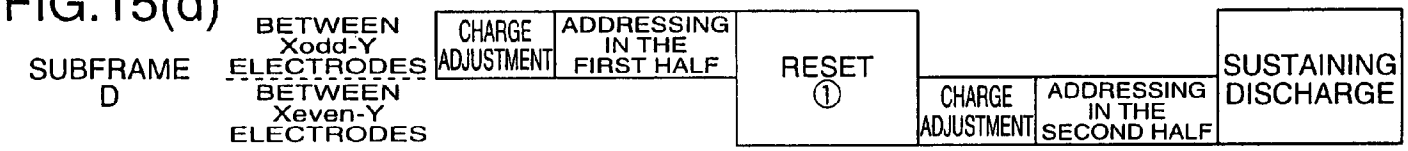
FIG.15(e)
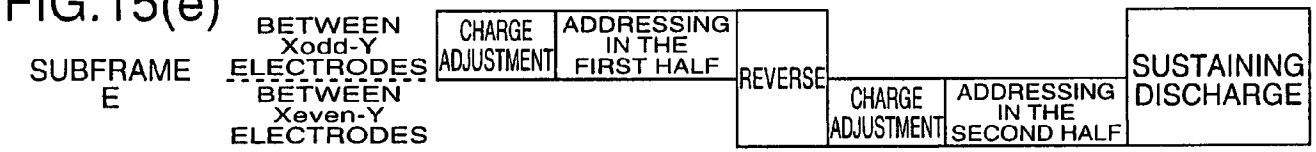
FIG.15(f)
| | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| LUMINANCE WEIGHT | 1 | 2 | 24 | 24 | 40 | 40 | 40 | 40 | 16 | 16 | 8 | 4 |
| SF PATTERN | A | B | C | B | C | B | D or E | D or E | A | B | C | B |

METHOD OF DRIVING PLASMA DISPLAY PANEL

CROSS-REFERENCE TO RELATED APPLICATION

This application is a continuation of application Ser. No. 09/986,922, filed Nov. 13, 2001, now abandoned. Further, this application is related to Japanese application No. 2001-185387 filed on Jun. 19, 2001, whose priority is claimed under 35 USC §119, the disclosure of which is incorporated by reference in its entirety.

BACKGROUND OF THE INVENTION

1. Field of the Invention

The present invention relates to a method of driving a plasma display panel (PDP) and more particular to a method of driving a plasma display panel comprising a plurality of display electrodes for producing surface discharge and a plurality of address electrodes (signal electrodes) for selection arranged orthogonally to each other between a pair of substrates.

2. Description of Related Art

In the above-described PDP, the display electrodes are extended in a row direction of a screen and arranged parallel to each other to have equal spaces therebetween. Display lines capable of producing surface discharge are defined between adjacent display electrodes. The address electrodes are extended in a column direction of the screen and arranged orthogonally to the display electrodes, thereby defining cells (unit light emitting regions) at points of intersection of the display lines and the address electrodes.

In a common PDP of surface discharge type, two display electrodes constitute a pair for producing surface discharge. Accordingly, a single display electrode between two adjacent display lines serves as a scan electrode for the two display lines. That is, at the time of producing address discharge for selecting a cell to illuminate, a single scan electrode is used both for an odd-numbered display line and an even-numbered display line. Accordingly, the displaying operation is generally carried out in an interlace mode. In this description, hereinafter, the PDP having a construction provided with the display electrodes arranged to have equal spaces therebetween will be referred to as an ALiS (Alternate Lighting of Surfaces) type PDP.

As compared with a PDP in which a pair of display electrodes is given for each of the display lines, the ALiS type PDP is advantageous to large-scale integration of the cells because it ensures the number of cells equal to that in the above-mentioned PDP while the number of the display electrodes is reduced. However, the interlace mode is inferior in display quality to a so-called progressive mode in which the display lines are scanned in sequence. Accordingly, various methods for driving the ALiS type PDP in the progressive mode have been proposed.

In the ALiS type PDP, as described above, a scan pulse is applied to every other display electrode used as the scan electrode in order to select a cell to illuminate. Since a single scan electrode is used for two display lines, a technique for selection between the two display lines is required.

Such a technique is known as described in Japanese Unexamined Patent Publication No. 2000-181402, in which auxiliary discharge is taken place before the scan pulse is applied to the display electrodes, so that one of the two display lines is selected depending on the existence of the auxiliary discharge. However, the technique takes much time for the addressing because an auxiliary pulse needs to be applied before the scan pulse, and thus not practical. Moreover, the driving circuit is complicated.

SUMMARY OF THE INVENTION

In view of the above problems, the present invention has been achieved to provide a method of driving the plasma display panel. The method comprises the steps of controlling a charge state of one of the two display lines both using the same scan electrode such that address discharge is not generated, controlling a charge state of the other display line such that address discharge can be generated, and then generating the address discharge, thereby to allow progressive mode display in the ALiS type PDP.

Thus, the present invention provides a method of driving a plasma display panel having a plurality of display electrodes and a plurality of address electrodes arranged orthogonally to each other between a pair of substrates forming a discharge space, display lines being defined between adjacent display electrodes by surface discharge, cells being defined at positions of intersection of the display lines and the address electrodes, a single display electrode between two adjacent display lines being utilized as a scan electrode at the time of producing address discharge to select a cell to illuminate, the method comprising: controlling a charge state of a first display line being one of the two adjacent display lines utilizing the same single scan electrode, such that address discharge is not generated and controlling a charge state of a second display line being the other of the two adjacent display lines, such that address discharge can be generated, and then generating address discharge in the second display line; controlling the charge state of the second display line such that address discharge is not generated and controlling the charge state of the first display line such that the address discharge can be generated, and then generating address discharge in the first display line; and generating surface discharge simultaneously in the first and second display lines, thereby to achieve progressive display.

According to the present invention, selection between two display lines utilizing the same scan electrode is carried out depending on whether the charges exist or not. That is, one of the two display lines utilizing the same scan electrode is turned to be unaddressable and the other is turned to be addressable, and then the addressing is carried out. Since the unaddressable state and the addressable state are easily produced, progressive display is allowed while ensuring sufficient driving margin.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 12 is a view illustrating the third embodiment of the present invention;

FIG. 15 is a view illustrating the sixth embodiment of the present invention.

DESCRIPTION OF THE PREFERRED EMBODIMENTS

In the present invention, the pair of substrates may be made of glass, quartz, ceramics or the like, or substrates on which desired components such as electrodes, insulating films, dielectric layers, protective films and the like are formed.

The display electrodes may be made of a transparent material such as ITO, SnO2 or the like, or a metallic material such as Ag, Au, Al, Cu, Cr or the like. For example, each of the display electrodes may be formed of a combination of a transparent electrode of a great width made of ITO or SnO2 and a metallic bus electrode of a small width for reducing electrode resistance made of Ag, Au, Al, Cu, Cr or layers of them (e.g., layers of Cr/Cu/Cr). The display electrodes may be formed by printing method if Ag or Au is used, or by combination of vapor deposition or sputtering and etching if other materials are used. Thus, a desired number of display electrodes are formed to have a desired thickness, width and spaces therebetween.

The address electrodes are not particularly limited as long as a large number of them are arranged orthogonally to the display electrodes. In general, the display electrodes are arranged parallel to the row direction of a screen and the address electrodes are arranged parallel to the column direction of the screen. The address electrodes produce address discharge at positions of intersection with the display electrodes for scanning and may be made of a metallic material such as Ag, Au, Al, Cu, Cr or the like. Since the address electrodes are formed on a back substrate, they may not necessarily be transparent. For example, Ag, Au, Al, Cu, Cr or layers thereof (e.g., Cr/Cu/Cr layers) may be used as a material for the address electrodes. The address electrodes may also be formed by printing method if Ag or Au is used, or by combination of vapor deposition or sputtering and etching if other materials are used. Thus, a desired number of address electrodes are formed to have a desired thickness, width and spaces therebetween.

In the PDP of the present invention, display lines are defined between adjacent display electrodes by surface discharge and cells are defined at positions of intersection of the display lines and the address electrodes. Then, a single display electrode between two adjacent display lines is used as a scan electrode at the time of producing address discharge to select a cell to illuminate.

Hereinafter, the present invention will be explained with reference to embodiments shown in the figures. However, the present invention is not limited thereto and various alterations are acceptable.

Figure 1:
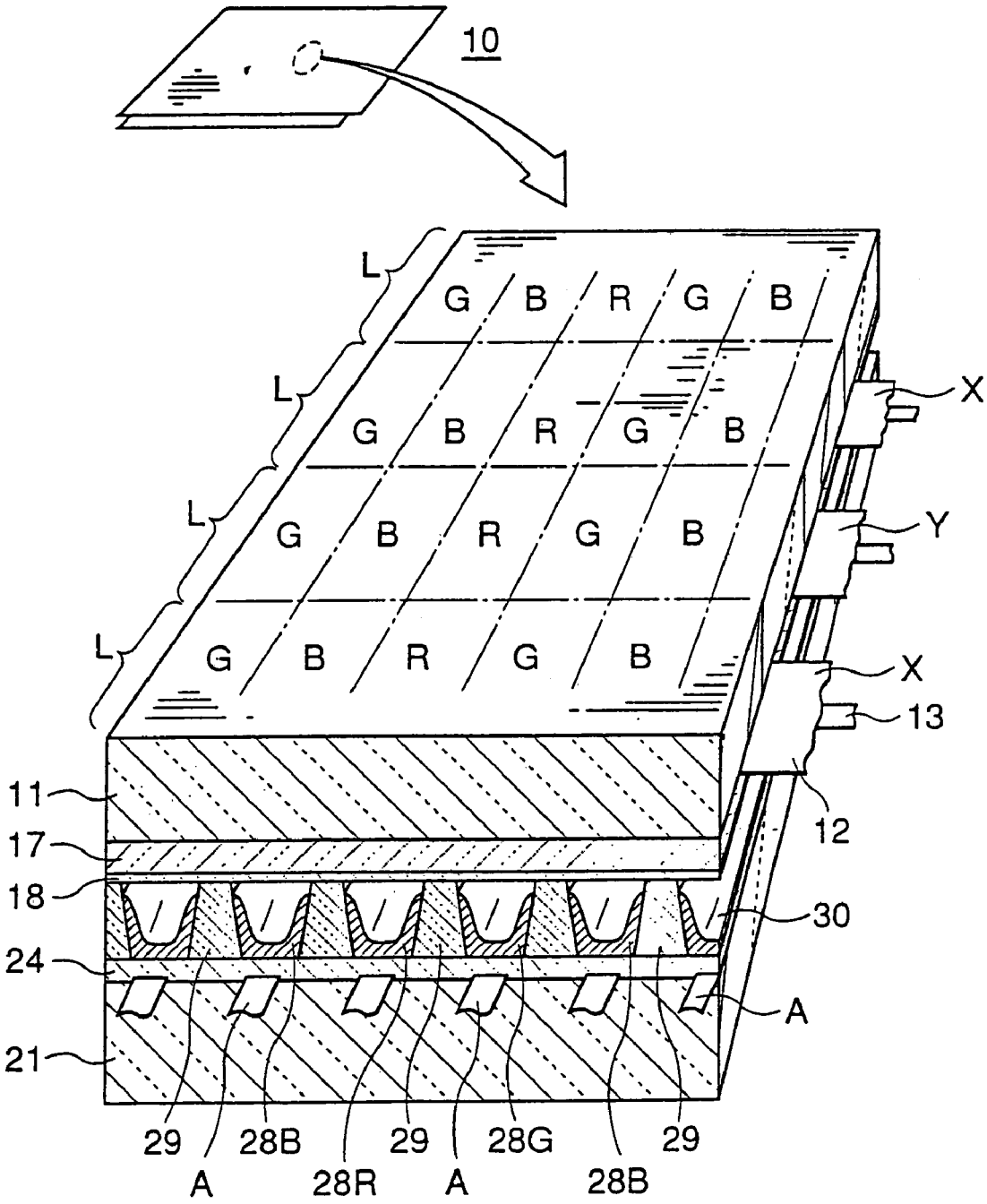
FIG. 1 is a view observed from an oblique direction partially illustrating a structure of ALiS type PDP to which a driving method according to the present invention is applied.

FIG. 1 is a view observed from an oblique direction for partially showing an ALiS type PDP which is driven by the method according to the present invention. This PDP is a surface discharging triple electrode AC-PDP for color display. In general, a plurality of display electrodes and a plurality of address electrodes are arranged orthogonally to each other between a pair of substrates.

The PDP 10 is formed of a front panel assembly including a front substrate 11 and a back panel assembly including a back substrate 21. The front and back substrates 11 and 21 are made of glass.

On an inner surface of the front substrate 11 a plurality of display electrodes X and Y extending in the row direction of a screen are arranged parallel to each other to have equal spaces therebetween such that surface discharge is produced between adjacent display electrodes. The display electrodes X and Y (may be referred to as X electrodes and Y electrodes) adjacent to each other produce surface discharge for display between them. The surface discharge is generally called as display discharge since it is used for the display, but also called as sustain discharge since it sustains illumination in the cell. In this sense, the display electrodes may be referred to as sustain electrodes.

Each of the display electrodes X and Y is formed of a transparent electrode 12 of a great width made of ITO, SnO2 or the like and a metallic bus electrode 11 for reducing electrode resistance of a small width made of Ag, Au, Al, Cu, Cr or layers thereof (e.g., layers of Cr/Cu/Cr). The display electrodes X and Y are formed by printing method if Ag or Au is used, or by combination of vapor deposition or sputtering and etching if other materials are used. Thus, a desired number of display electrodes X and Y are formed to have a desired thickness, width and spaces therebetween. For the addressing, the display electrodes Y are used as scan electrodes.

The transparent electrode 12 may be belt shaped, or formed to have wide portions corresponding to the discharge cells, or separated in one-to-one relation with the discharge cells and commonly connected via the bus electrode.

On the front substrate 11 a dielectric layer 17 is formed by applying a glass paste prepared by adding a binder and a solvent to a low-melting glass frit by screen printing and then calcining the paste.

On the dielectric layer 17, a protective film 18 is formed to protect the dielectric layer 17 from damages caused by collision of ions generated during the discharge for display. The protective film 18 may be formed of MgO, CaO, SrO, BaO or the like.

On an inner surface of the back substrate 21, a plurality of address electrodes A (may be referred to as A electrodes) extending in the column direction of the screen are arranged parallel to each other such that they intersect with the display electrodes X and Y. The address electrodes A produce address discharge at positions of intersection with the display electrodes utilized as the scan electrodes and may be formed of Ag, Au, Al, Cu, Cr or layers thereof (e.g., layers of Cr/Cu/Cr). The address electrodes A may also be formed by printing method if Ag or Au is used, or by combination of vapor deposition or sputtering and etching if other materials are used. Thus, a desired number of address electrodes A are formed to have a desired thickness, width and spaces therebetween.

A dielectric layer 24 is formed on the address electrodes A with the same material by the same method as the dielectric layer 17.

At positions between adjacent address electrodes A on the dielectric layer 24, barrier ribs 29 are formed by sand blasting, printing, photo etching or the like. For example, the barrier ribs 29 are formed by applying a glass paste made of a low-melting glass frit, a binder, a solvent and the like on the dielectric layer 24, drying the paste, shaving it by sand blasting, followed by calcination. It is also possible to use a photosensitive resin as the binder so that the barrier ribs are formed by light exposure, development and calcination.

On groove portions between the barrier ribs 29, fluorescent pastes each containing a binder and fluorescent powders of different colors are applied sequentially by screen printing or using a dispenser and then calcined to form fluorescent layers 28R, 28G and 28B, respectively. Alternatively, the fluorescent layers 28R, 28G and 28B may be formed by photolithography using a fluorescent sheet material containing the fluorescent powders and the binder (a so-called green sheet). In this case, a sheet of required color is applied to the entire display region on the substrate, exposed to light and developed. This is repeated by using sheets of different colors to form the fluorescent layers of each color between the barrier ribs.

The above-described front substrate assembly and back substrate assembly are faced to each other such that the display electrodes X, Y and the address electrodes A are orthogonal to each other. Their circumferences are sealed and spaces surrounded by the barrier ribs are filled with discharge gas such as a mixture of neon and xenon. Thus, the PDP 10 is completed. In the PDP 10, discharge spaces at positions of intersection of the display electrodes X, Y and the address electrode A constitute a cell (a unit light emitting region), respectively.

Figure 2:
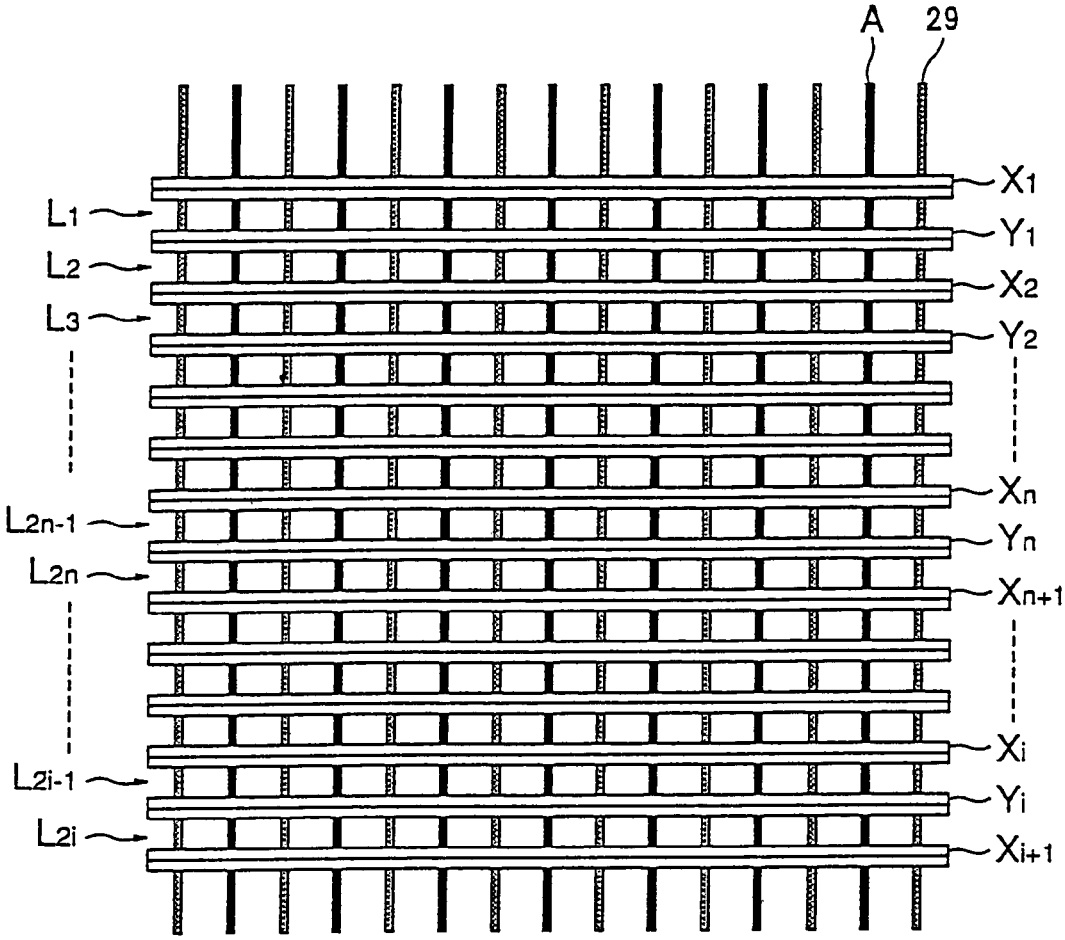
FIG. 2 is a plan view illustrating the ALiS type PDP in an embodiment of the present invention.

FIG. 2 is a plan view of the ALiS type PDP described above.

According to the PDP, the display electrodes Xn, Yn extending in the row direction of the screen are arranged parallel to each other and the address electrodes A extending in the column direction of the screen are arranged in an orthogonal relation with the display electrodes. The barrier ribs 29 are formed between adjacent address electrodes A in a direction parallel to the address electrodes A. The number of the display electrodes is larger by 1 than the number of the discharge cells in the row direction, i.e., larger by 1 than the number of the display lines L. the number of the address electrodes A is equal to that of the discharge cells in the column direction.

Among the display lines L, a first display line L1 lies between the display electrodes X1 and Y1, a second display line L2 lies between the display electrodes Y1 and X2, a third display line L3 lies between the display electrodes X2 and Y2. That is, the (2n−1)th display line L2*n*−1 lies between the display electrodes Xn and Yn, and the 2 nth display line L2*n* lies between the display electrodes Xn and Yn+1.

Figure 3:
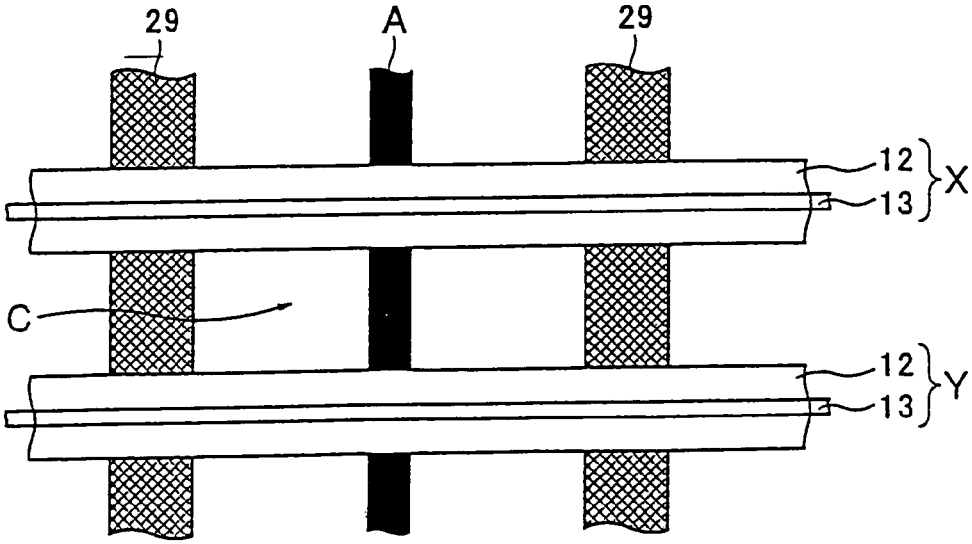
FIG. 3 is a partially enlarged view illustrating a detailed structure of the ALiS type PDP in an embodiment of the present invention.

FIG. 3 is a partially enlarged view illustrating a detailed structure of the ALiS type PDP. As shown in FIG. 3, the display discharge is taken place between the display electrodes in an area sandwiched between the barrier ribs 29. Accordingly, a region between the display electrodes X, Y sandwiched between the barrier ribs 29 constitutes a discharge cell C.

Figure 4:
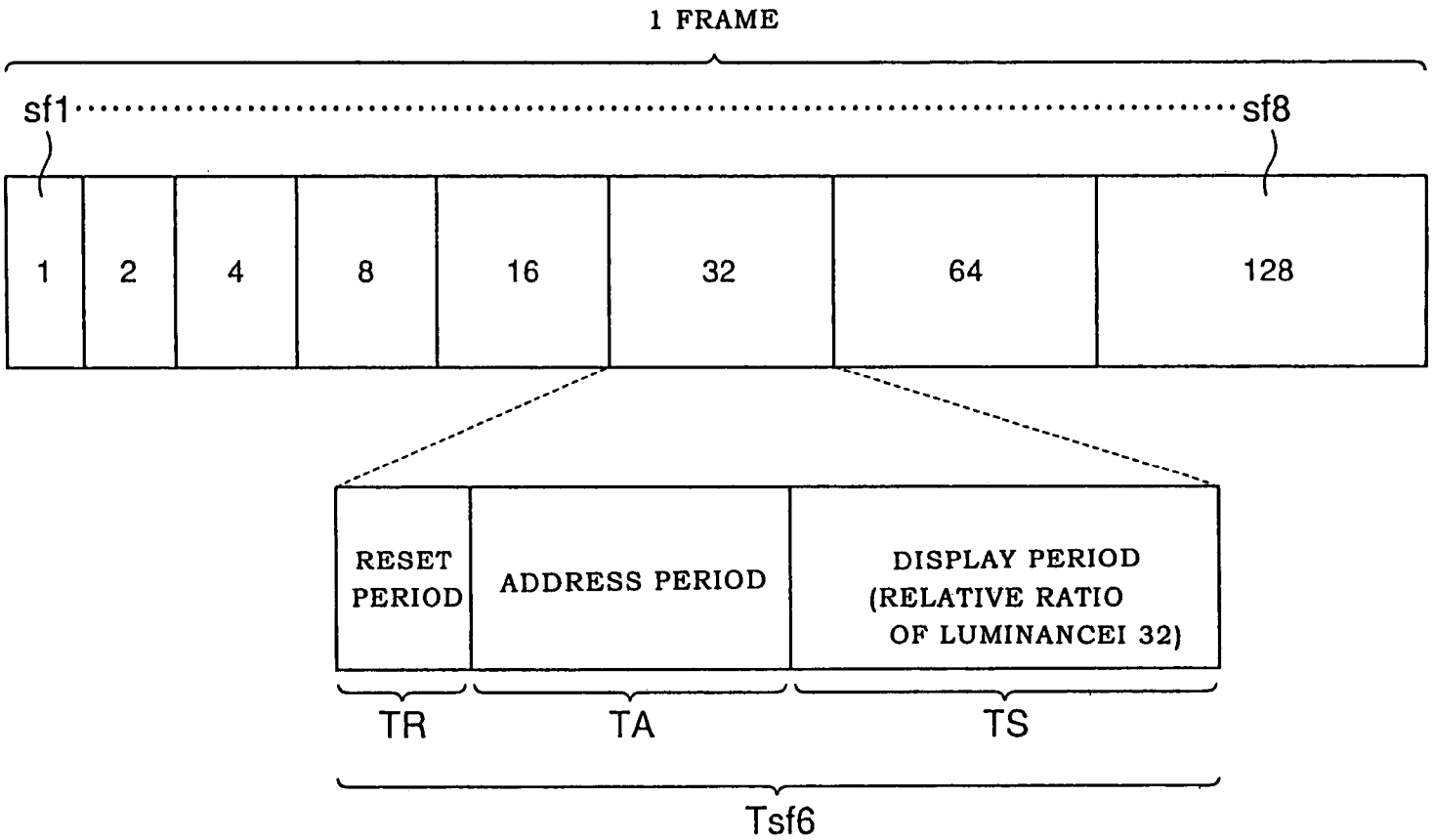
FIGS. 4(*a*) and 4(*b*) are views illustrating a driving mode for giving gradation of color display in an embodiment of the present invention.

FIGS. 4(*a*) and 4(*b*) are views illustrating a driving mode for giving gradation in color display. A color display PDP is generally driven by the following gradation driving mode.

A period for a single frame (1/60 sec in general) for displaying animation is constituted of plural subframes each having weighted luminance. In order to produce gradation of 256 levels, a single frame is constituted of 8 subframes sf1 to sf8 and the subframes are displayed for a period in the ratio of 1:2:4:8:16:32:64:128, respectively, i.e., the cell is discharged by the number of times in that ratio.

Each subframe is constituted of a reset period TR for equalizing wall charges in the entire cells in the discharge area, an address period TA for selecting a cell to illuminate and a display (sustain) period TS for discharging (illuminating) the selected cell in the number of times according to the luminance. Upon displaying the subframes, the cells are illuminated according to the luminance in order to display 8 subframes, thereby forming one frame. FIG. 4(*b*) illustrates a subframe having the relative ratio of luminance of 32.

Addressing for display is carried out in a write addressing mode and an erase addressing mode. In the write addressing mode, wall charges in the entire cells are erased in the reset period TR, the wall charges are selectively formed in a cell to illuminate in the address period TA and then display discharge is taken place in the display period TS. In the erase addressing mode, wall charges are formed in the entire cells in the reset period TR such that the cells are ready for addressing, the wall charges are selectively erased from the cells not to illuminate in the address period TA and then display discharge is generated in the display period TS.

The above-mentioned ALiS type PDP is basically driven in such a gradation driving mode. In the ALiS type PDP, a single Y electrode between an odd-numbered display line L1, 3, 5 . . . and an even-numbered display line L2, 4, 6 . . . , respectively, is used as the scan electrode to apply the scan pulse for selecting a cell to illuminate. Therefore, the selection between the odd-numbered display line and the even-numbered display line is carried out in the following manner.

Figure 5:
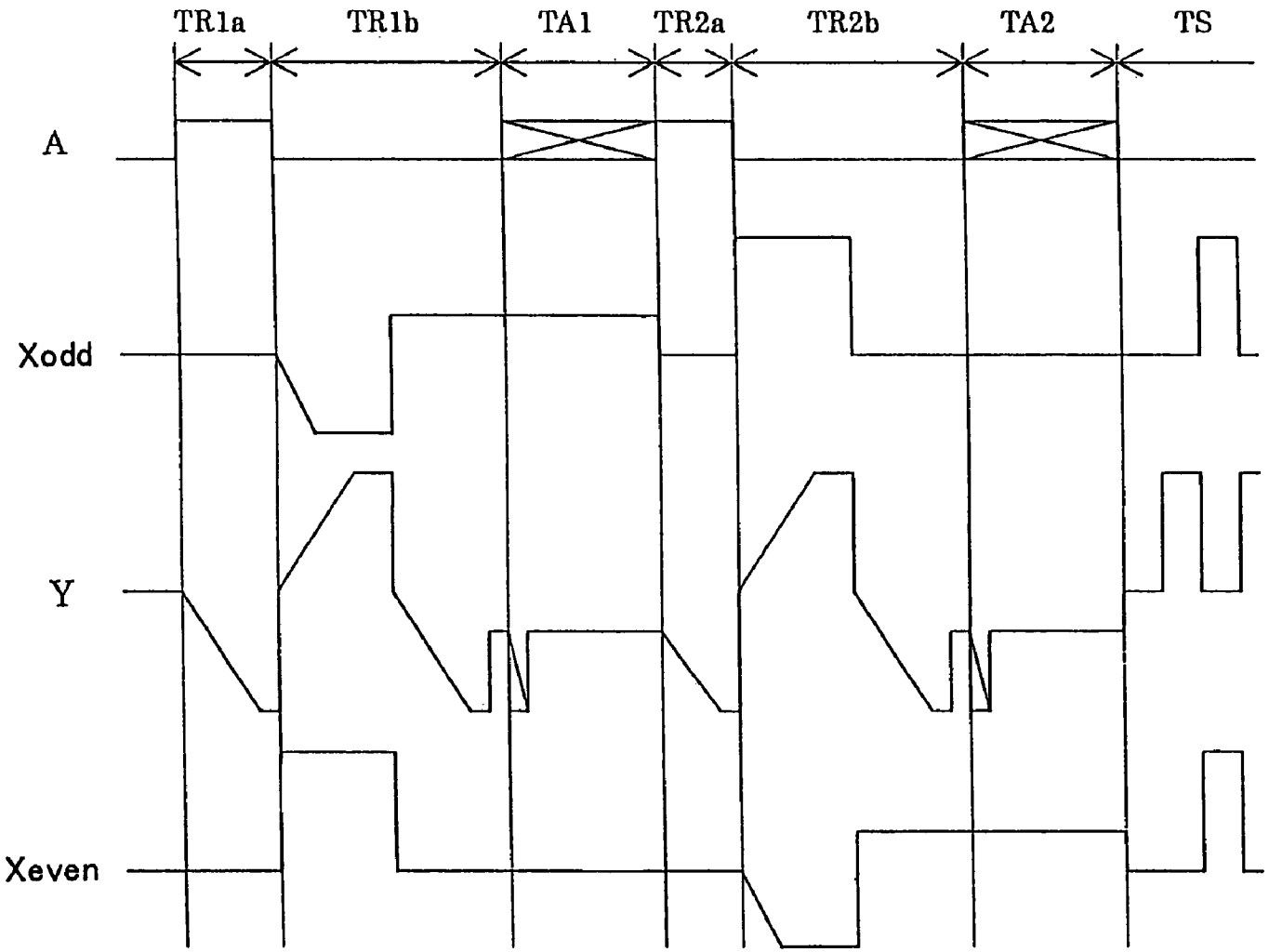
FIG. 5 is a view illustrating waveforms of applied voltages according to the first embodiment of the present invention.

FIG. 5 illustrates waveforms of applied voltages according to the first embodiment of the method of driving the PDP.

In the ALiS type PDP, Y electrodes to be used as scan electrodes and X electrodes to which the scan pulse is not applied are alternately arranged. The Y electrodes can independently be controlled because the scan pulse is applied thereto. Among the X electrodes, odd-numbered X electrodes are classified as a first group (Xodd electrodes) and even-numbered X electrodes are classified as a second group (Xeven electrodes). The Xodd electrodes and the Xeven electrodes are commonly connected, respectively.

During the first half of the address period, display lines between the Xodd electrodes and the Y electrodes are addressed. During the second half of the address period display lines between the Xeven electrodes and the Y electrodes are addressed. Thereafter, discharge is taken place in all the display lines simultaneously.

Specifically, the reset period TR is divided into a first reset period TR1 and a second reset period TR2. The first reset period TR1 is constituted of a first step TR1*a* and a second step TR2*b* and the second reset period TR2 is constituted of a first step TR2*a* and a second step TR2*b*.

The address period TA is also divided into a first address period TA1 and a second address period TA2. Addressing for display is operated in the write addressing mode. For the display period TS, all the display lines are discharged in the progressive mode.

During the first step TR1*a* of the first reset period, voltages having waveforms shown in FIG. 5 are applied to the A electrode and the Y electrode, respectively. Discharge is generated from the A electrode to the Y electrode, thereby forming wall charges on the Y electrode. Thus, a charge state of all the display lines between the Xodd electrode and the Y electrode and between the Xeven electrode and the Y electrode is controlled such that the discharge does not occur in a subsequent address period unless discharge for initialization is generated (hereinafter this is referred to an unaddressable state).

Next, discharge is generated between the Xodd electrode and the Y electrode in the second step TR1*b* of the first reset period so that only the discharge line between the Xodd electrode and the Y electrode is initialized. Thus, the display line becomes addressable.

Then, in the first address period TA1, discharge is generated between the Xodd electrode and the Y electrode so that the discharge line between the Xodd electrode and the Y electrode is addressed.

In the same manner as in the first step TR1*a* of the first reset period, discharge is generated from the A electrode to the Y electrode to form wall charges on the Y electrode in the first step TR2*a* of the second reset period. Thus, a charge state of the discharge lines between the Xodd electrode and the Y electrode and between the Xeven electrode and the Y electrode is controlled such that the discharge does not occur in a subsequent address period unless discharge for initialization is generated (unaddressable state).

Then, in the second step TR2*b* of the second reset period, discharge is generated between the Xeven electrode and the Y electrode to initialize the discharge line only between the Xeven electrode and the Y electrode, thereby to bring the discharge line in the addressable state.

Then in the second address period TA2 discharge is generated between the Xeven electrode and the Y electrode to address the discharge line between the Xeven electrode and the Y electrode.

After a voltage is applied from the Y electrode to both of the Xodd electrode and the Xeven electrode to generate display discharge, a voltage is then applied from the Xodd and Xeven electrodes to the Y electrode to generate display discharge. This is repeated to discharge all the display lines simultaneously.

In the first step TR2*a* of the second reset period, the following conditions need to be satisfied:

(1) Charges in a cell in which address discharge is taken place in the first half (the first address period TA1) are maintained without erasing so that they are utilized for display discharge;

(2) A charge state in a cell in which address discharge is not taken place in the first half is controlled such that the discharge does not occur in the second half (the second address period TA2); and (3) Charges enough to allow the discharge during the display discharge are not accumulated in the cell in which address discharge is not taken place in the first half.

The conditions are satisfied by applying a voltage of a gentle waveform (slant pulse) having the same polarity and amplitude as those of the addressing voltage between the A electrode and the Y electrode at the beginning of the first and second halves of the addressing. The reason is as follows.

Since the voltage applied in the first step TR2*a* of the second reset period in the second half has the same polarity as that of the address voltage applied in the first half of the addressing, the condition (1) is easily satisfied.

Further, since the voltage also has the same amplitude as that of the address voltage, the reaction does not occur in a subsequent address period. Therefore the condition (2) is satisfied.

By merely applying the voltage of the gentle waveform between the A electrode and the Y electrode, charges which allow the display discharge are not accumulated, so that the condition (3) is also satisfied.

As long as the conditions (1) to (3) are satisfied, the voltage to be applied to the Y electrode in the first step TR2*a* of the second reset period may not necessarily be in the gentle waveform. For example, a pulse of narrow width may be applied between the A electrode and the Y electrode.

In this embodiment, the display line between the Xodd electrode and the Y electrode is addressed prior to the display line between the Xeven electrode and the Y electrode. However, the addressing may be carried out in an opposite order.

Also in the first step TR1*a* of the first reset period, a voltage having the same waveform as the voltage applied during the first step TR2*a* of the second reset period is applied. However, this voltage is not necessary in view of possibility of driving because even if erroneous discharge is generated between the Xeven electrode and the Y electrode during the first address period TA1, initialization is performed in the first and second steps TR2*a* and TR2*b* of the second reset period, and then the addressing is carried out again in the second address period TA2. However, the erroneous discharge between the Xeven electrode and the Y electrode during the first address period TA1 causes a problem of increase of background illumination. Therefore it is desirable to insert the voltage with the aforementioned waveform in the first step TR1*a* of the first rest period.

The entirety of the first embodiment is as described above. Hereinafter sequence and driving waveform according to the first embodiment will be detailed below, though the description might overlap with the above.

Figure 6:
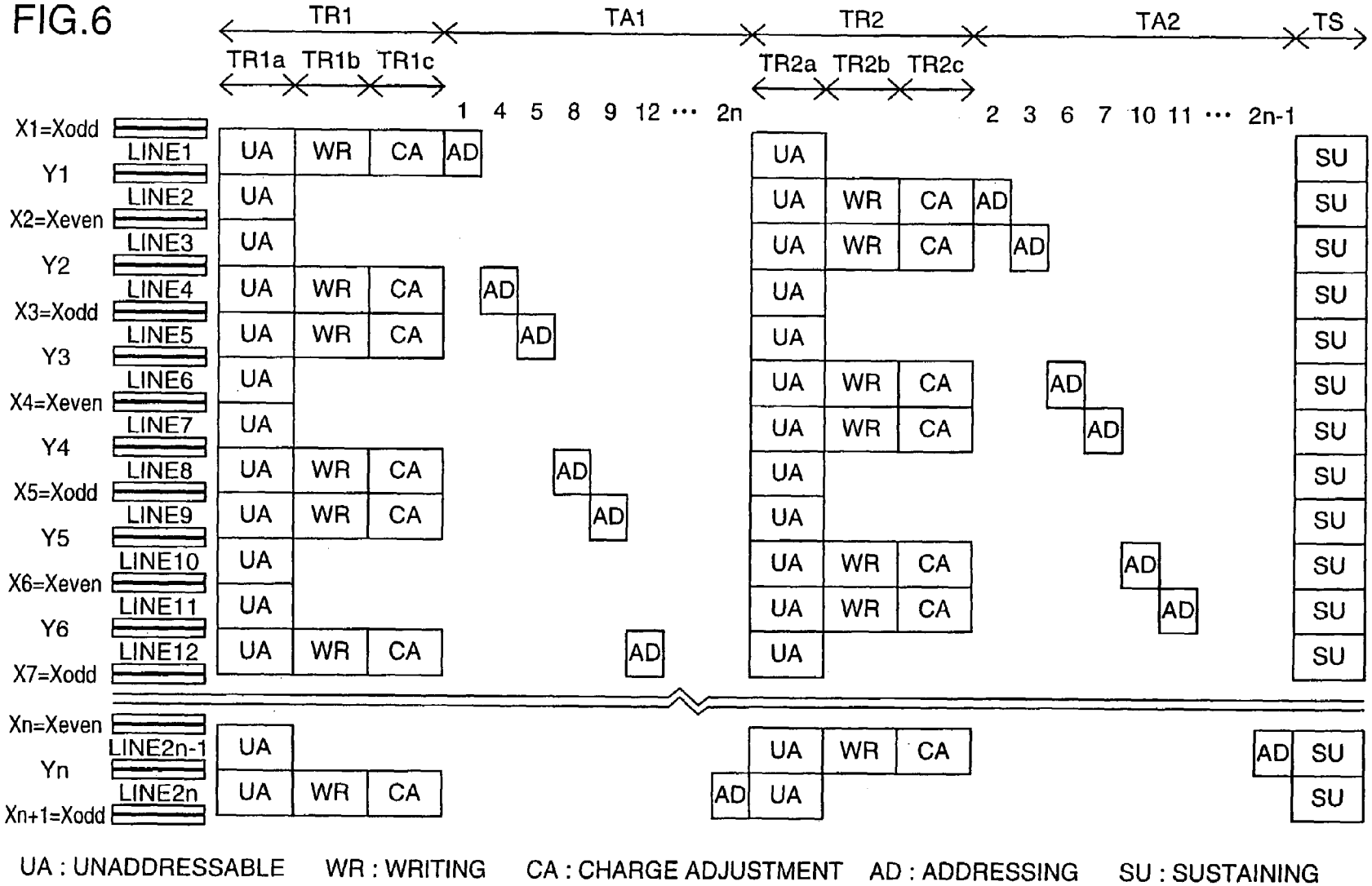
FIG. 6 is a view illustrating a detailed sequence according to the first embodiment of the present invention.

The detailed sequence according to the first embodiment is shown in FIG. 6. As mentioned above, the sequence according to the first embodiment is mainly consisted of the first reset period TR1, the first address period TA1, the second reset period TR2, the second address period TA2 and the sustain period TS.

In the above explanation of the first embodiment, the first reset period TR1 is divided into two sequences of the first step TR1*a* and the second step TR1*b*. More specifically, the second step TR1*b* is further divided into two sequences of Write and Charge adjustment. Therefore, the first reset period TR1 is constituted of three sequences of the first step TR1*a*, the second step of TR1*b* and the third step of TR1*c*.

Also the second reset period TR2 is described to include two sequences of the first step TR2*a* and the second step TR2*b* in the first embodiment. In detail, the second step TR2*b* is also divided into two sequences of Write and Charge adjustment. Therefore, the second reset period TR2 is consisted of the first step TR2*a*, the second steps TR2*b* and the third step of TR2*c*.

In the overall operation, the X electrodes are divided into Xodd electrodes and Xeven electrodes in the same manner as the above. Display lines using the Xodd electrodes are addressed in the first address period and display lines using the Xeven electrodes are addressed in the second address period. Then all the display lines are discharged in the sustain period to achieve progressive display.

The first reset period TR1 is a preparatory period for normally generating address discharge in the subsequent first address period TA1. In the first address period TA1 the display lines using the Xodd electrodes are addressed. Accordingly, in the first reset period TR1 the display lines using the Xodd electrodes are in an addressable state and the display lines using the Xeven electrodes are in an unaddressable state.

In the first step TR1*a* of the first reset period, the charge state of all the display lines is controlled such that the address discharge does not occur (unaddressable state). Then, only to the display lines using the Xodd electrodes writing is performed in the second step TR1*b* and charge adjustment is carried out in the third step TR1*c*, thereby to bring the display lines in the addressable state. In the second step TR1*b* and the third step TR1*c* the display lines using the Xeven electrodes are not reacted and maintained in the unaddressable state.

Then, in the first address period TA1, a scan pulse is applied to the Y electrodes successively from the top and an address pulse is applied to the A electrodes, thereby to perform addressing. In the first address period TA1, only the display lines using the Xodd electrodes are in the addressable state, so that the display lines between the Y electrodes and the Xodd electrodes are selectively addressed. The display electrodes are addressed two by two, i.e., the 1st, 4th, 5th, 8th, 9th . . . display electrodes are addressed. Accordingly, the address pulse to be applied to the A electrodes is also applied in the same order.

The second reset period TR2 is a preparatory period for normally generating address discharge in the subsequent second address period TA2. Contrary to the first address period TA1, only the display lines using the Xeven electrodes are addressed in the second address period TA2. Accordingly, in the second reset period TR2, the display lines using the Xodd electrodes and the display lines using the Xeven electrodes are operated in the order opposite to that in the first reset period TR1.

In the sequence of the second address period TA2, the scan pulse is applied to the Y electrodes from the top and the address pulse is applied to the A electrodes in the same manner as in the first address period TA1, thereby to perform addressing. In the second address period TA2 only the display lines between the Xeven electrodes and the Y electrodes are in the addressable state. Thus, the display lines are addressed two by two, i.e., the 2nd, 3rd, 6th, 7th . . . display lines are addressed.

All the display lines are thus addressed. Thereafter, sustain discharge is generated during the display period TS to achieve progressive display.

Figure 7:
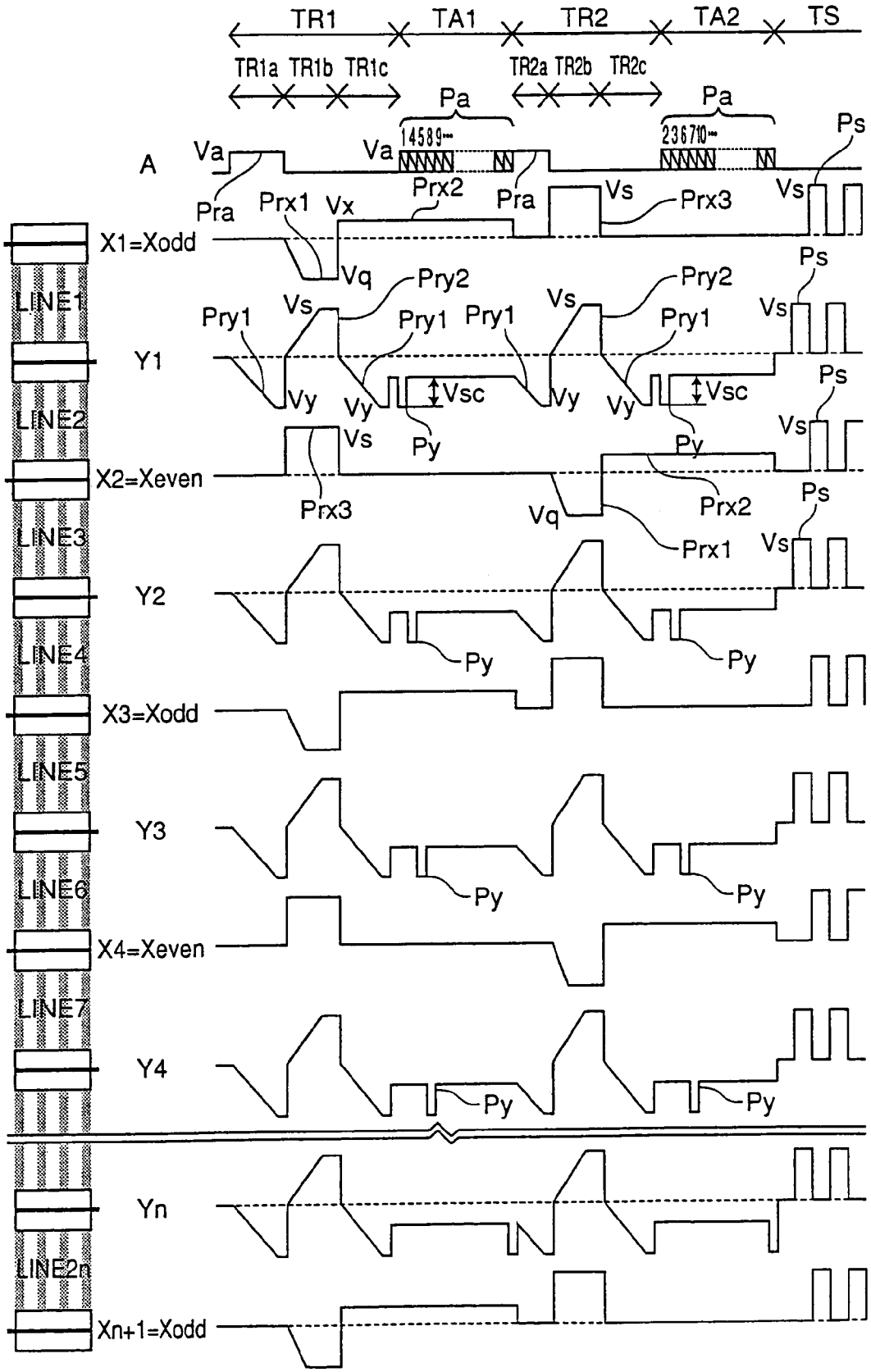
FIG. 7 is a view illustrating detailed driving waveforms according to the first embodiment of the present invention.

FIG. 7 shows detailed driving waveforms. The driving waveforms are consisted of the following voltage pulses:

- a gentle pulse Prx1 to be applied to the X electrodes having a voltage Vq at the highest
- a rectangular pulse Prx2 to be applied to the X electrodes having a voltage Vx
- a rectangular pulse Prx3 to be applied to the X electrodes having a voltage Vs
- a gentle pulse Prx1 to be applied to the Y electrodes having a voltage Vy at the highest
- a rectangular pulse Prx2 to be applied to the Y electrodes having a voltage Vs at the highest
- a scan pulse Py to be applied to the Y electrodes having a voltage Vy at the lowest and an amplitude Vsc
- a rectangular pulse Pra to be applied to the A electrodes having a voltage Va
- an address pulse Pa to be applied to the A electrodes having a voltage Va
- a sustain pulse Ps to be applied to the X and Y electrodes having a voltage Vs Typical examples of the voltage pulses are as follows.

Vq=−140V, Vx=90V, Vs=170V, Vy=−170V, Vsc=120V, Va=70V

Pulse application in the first step TR1*a*, the second step TR1*b* and the third step TR1*c* of the first reset period TR1 is performed as follows.

In the first step TR1*a* (unaddressable state), the pulses Pra and Pry1 are applied. Voltage level in both of the Xodd and Xeven electrodes is 0V (ground level). When the pulses Pra and Pry1 are applied, the voltage level is the same as that between the A electrodes and the Y electrodes at the addressing. Accordingly, the charges are brought to a state where the address discharge does not occur after the first step TR1*a*. The pulse width is about 100 μsec.

In the second step TR1*b* (Write to the display lines using the Xodd electrodes only), the pulse Prx1 is applied to the Xodd electrodes, the pulse Prx3 is applied to the Xeven electrodes, the pulse Pry2 is applied to the Y electrodes, and 0V is applied to the A electrodes. In this case, the Xodd electrodes have a polarity opposite to that of the Y electrodes and the Xeven electrodes have the same polarity as that of the Y electrodes. Accordingly, writing is performed only in the display lines using the Xodd electrodes. The pulse width is about 100 μsec.

In the third step TR1*c* (Charge adjustment), the pulse Prx2 is applied to the Xodd electrodes, 0V is applied to the Xeven electrodes, the pulse Pry1 is applied to the Y electrodes and 0V is applied to the A electrodes. Charges deposited in the second step TR1*b* on the display lines using the Xodd electrodes are adjusted by the pulses Prx2 and Pry1 such that the display lines are brought to a state suitable for addressing. The display lines using the Xeven electrodes are not reacted because the charges are not deposited in the second step TR1*b*. The pulse width is about 120 μsec.

In the first address period TA1, the pulse Prx2 is applied to the Xodd electrodes, 0V is applied to the Xeven electrodes, the Y electrodes are applied with the pulse Py and the A electrodes are applied with the pulse Pa, thereby to address the display lines using the Xodd electrodes. Each of the scan pulses has a width in the range of 1.2 to 1.7 μsec.

In the second reset period TR2, the pulses applied to the Xodd and Xeven electrodes in the first reset period TR1 are replaced with each other. Accordingly, only the Xeven electrodes become addressable.

In the second address period TA2, the pulse Prx2 is applied to the Xeven electrodes, 0V is applied to the Xodd electrodes, the pulse Py is applied to the Y electrodes and the pulse Pa is applied to the A electrodes. Accordingly, display lines using the Xeven electrodes are addressed. Each of the scan pulses has a width in the range of 1.2 to 1.7 μsec.

In the sustain period TS, the pulse Ps is alternately applied to the X and Y electrodes, thereby to generate sustain discharge.

Figure 8:
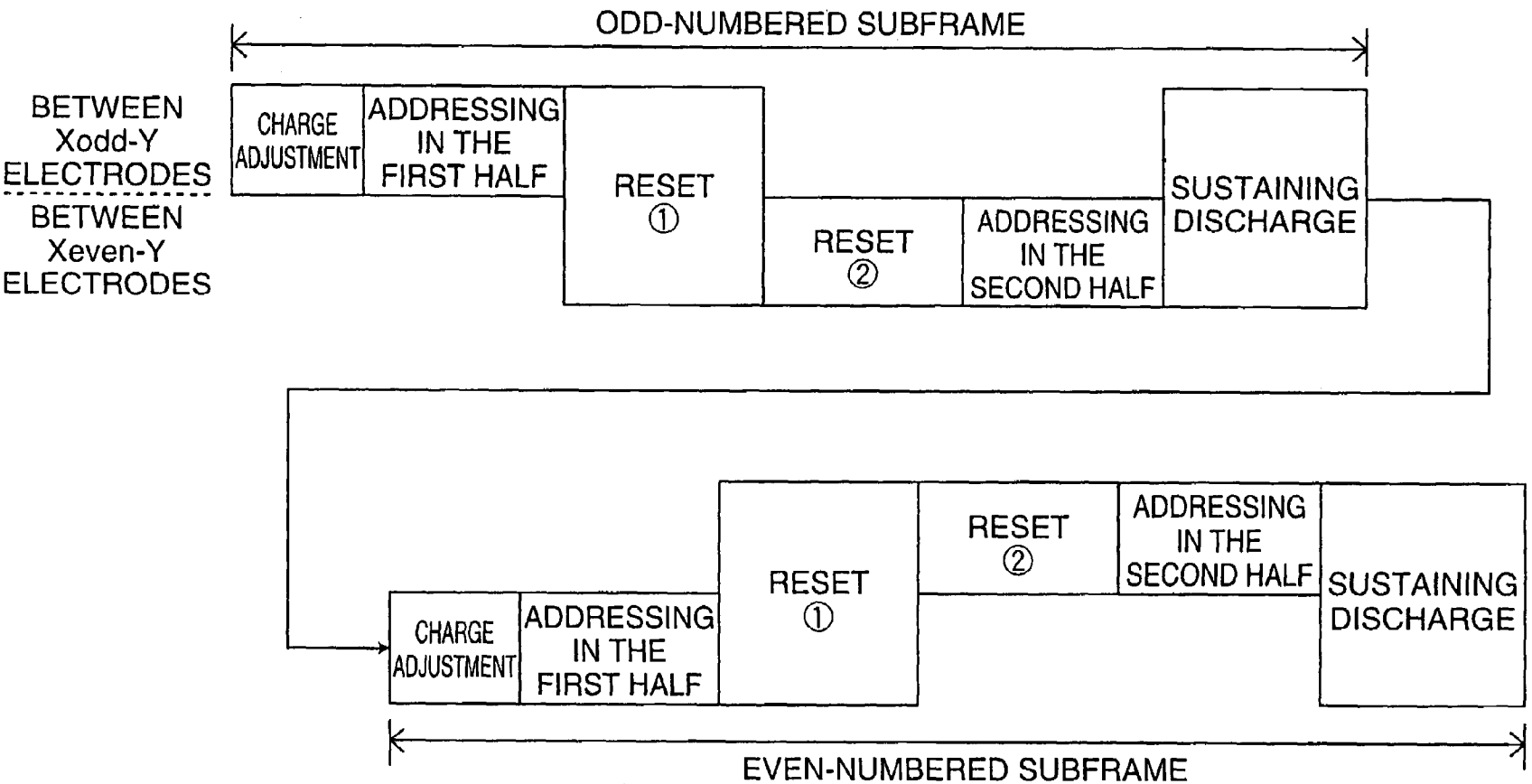
FIG. 8 is a block diagram illustrating voltage application according to the second embodiment of the present invention.
Figure 9:
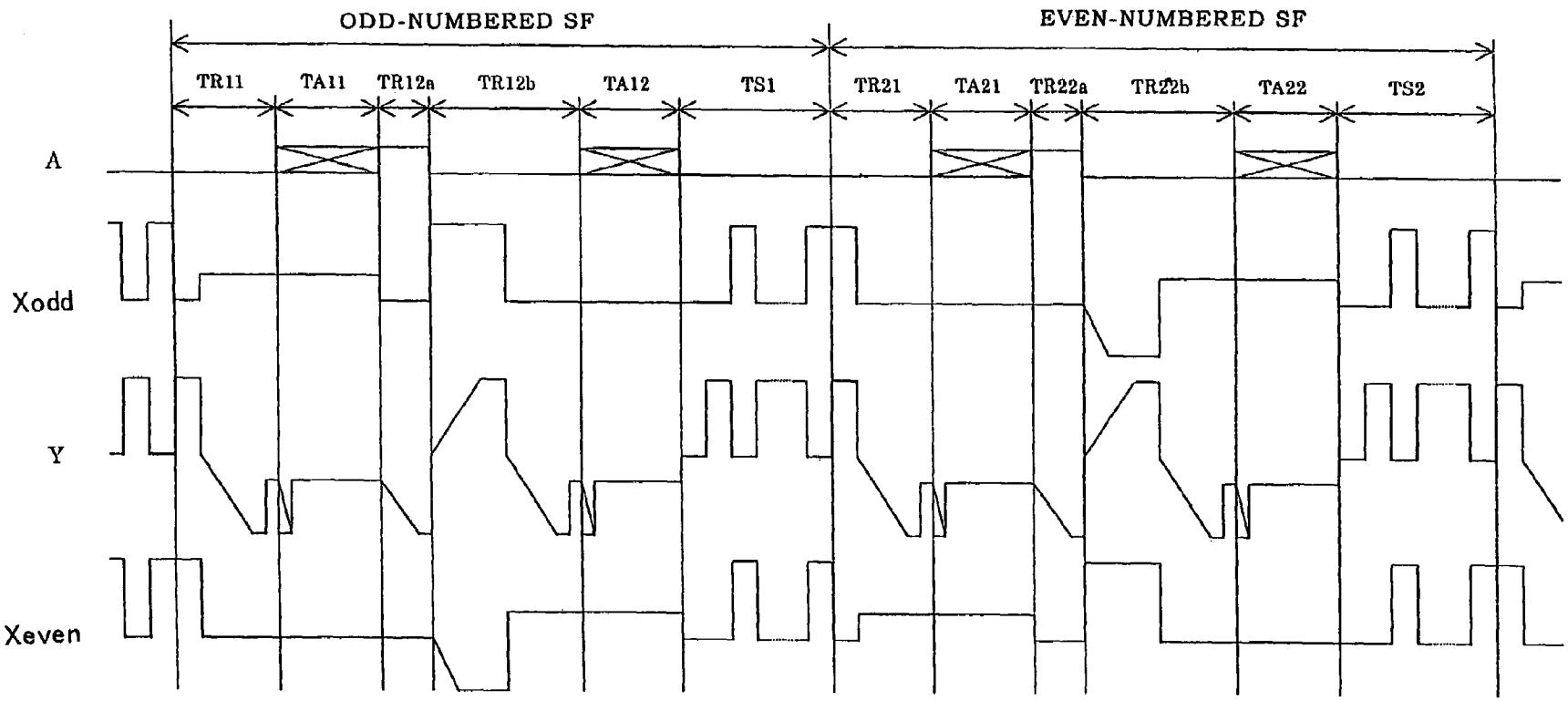
FIG. 9 is a view illustrating waveforms of applied voltages according to the second embodiment of the present invention.

FIGS. 8 and 9 show the second embodiment of the method of driving the PDP according to the present invention. FIG. 8 is a block diagram showing voltage application pattern, and FIG. 9 shows waveforms of applied voltages. This embodiment is a simplified version of the first embodiment.

Voltage application in the first and second steps TR1*a* and TR1*b* of the first reset period in the first half, i.e., initialization in the first half, performed in the first embodiment is not necessarily carried out in the second embodiment, because, in the display lines addressed in the second half of the preceding subframe, cells in which display discharge did not occur during the preceding subframe (i.e., address discharge was not produced) are still addressable, which eliminates the need of initialization.

The cells, in which display discharge was generated in the preceding subframe, are turned to be addressable by adjusting charges accumulated through the display discharge. That is, in this charge adjustment, wall charges generated between the A and Y electrodes are adjusted to be not less than a value obtained by reducing a voltage applied between the A and Y electrodes at the addressing from a voltage applied between the A and Y electrodes at the beginning of discharge. Further, wall charges generated between the X and Y electrodes are adjusted to be not greater than a value obtained by reducing a voltage applied between the X and Y electrodes at the display discharge from a voltage applied between the X and Y electrodes at the beginning of discharge.

With the charge adjustment described above, cells in which display discharge was produced in the preceding subframe turn to be addressable. Accordingly, when display lines addressed in the second half of the preceding subframe is addressed in the first half of the subsequent subframe, the charge adjustment substitutes for the initialization in the first half, and thus the initialization is carried out only in the second half.

Accordingly, in this embodiment, display lines to be addressed in the first half (first address lines) and display lines to be addressed in the second half (second address lines) are replaced in every subframe.

In other words, in an odd-numbered subframe, the display lines between the Xodd electrodes and the Y electrodes are addressed in the first half and the display lines between the Xeven electrodes and the Y electrodes are addressed in the second half. Then in an even-numbered subframe, the display lines between the Xeven and Y electrodes are addressed in the first half and the display lines between the Xodd and Y electrodes are addressed in the second half.

Operation in the even-numbered subframe is as described below. Since the Xodd electrodes were ended in a positive state at the display discharge in the preceding frame (i.e., the odd-numbered subframe), cells between the Xodd electrodes and the Y electrodes that were illuminated in the preceding subframe are brought to a charge state where the cells do not react with the addressing in the reset period TR21.

On the other hand, cells that were not illuminated in the preceding subframe were turned to a charge state where the addressing does not occur in the first step TR12*a* of the second reset period in the preceding subframe, and the state has been continued. Therefore, the display lines between the Xodd electrodes and the Y electrodes are always in the state where the addressing is not carried out.

Since the Xeven electrodes were ended in a negative state at the display discharge in the preceding subframe, cells between the Xeven electrodes and the Y electrodes that were illuminated in the preceding frame are brought to a state where the cells are reacted with the addressing in the first reset period TR21. In such a state, however, such a great amount of charges are accumulated that can generate display discharge even if the address discharge is not produced in the first address period TA21. Accordingly, the charges need to be adjusted by reduction with the gentle wave pulse as in the present embodiment.

On the other hand, cells that were not illuminated in the preceding subframe became addressable in the second step TR12*b* of the second reset period in the preceding subframe and the state has been continued. Therefore, the display lines between the Xodd electrodes and the Y electrodes are always addressable.

After the first address period TA21, the operation goes on in the same manner as in the first embodiment.

The present embodiment is advantageous in the following points:

(1) The number of times of the initialization performed in a single subframe is half reduced as compared with the first embodiment, so that background illumination is also half reduced; and (2) The initialization in the first half is simplified, so that time required for a single subframe is reduced.

The entirety of the second embodiment is as described above. Hereinafter sequence and driving waveform according to the second embodiment will be detailed below, though the description might overlap with the above.

Figure 10:
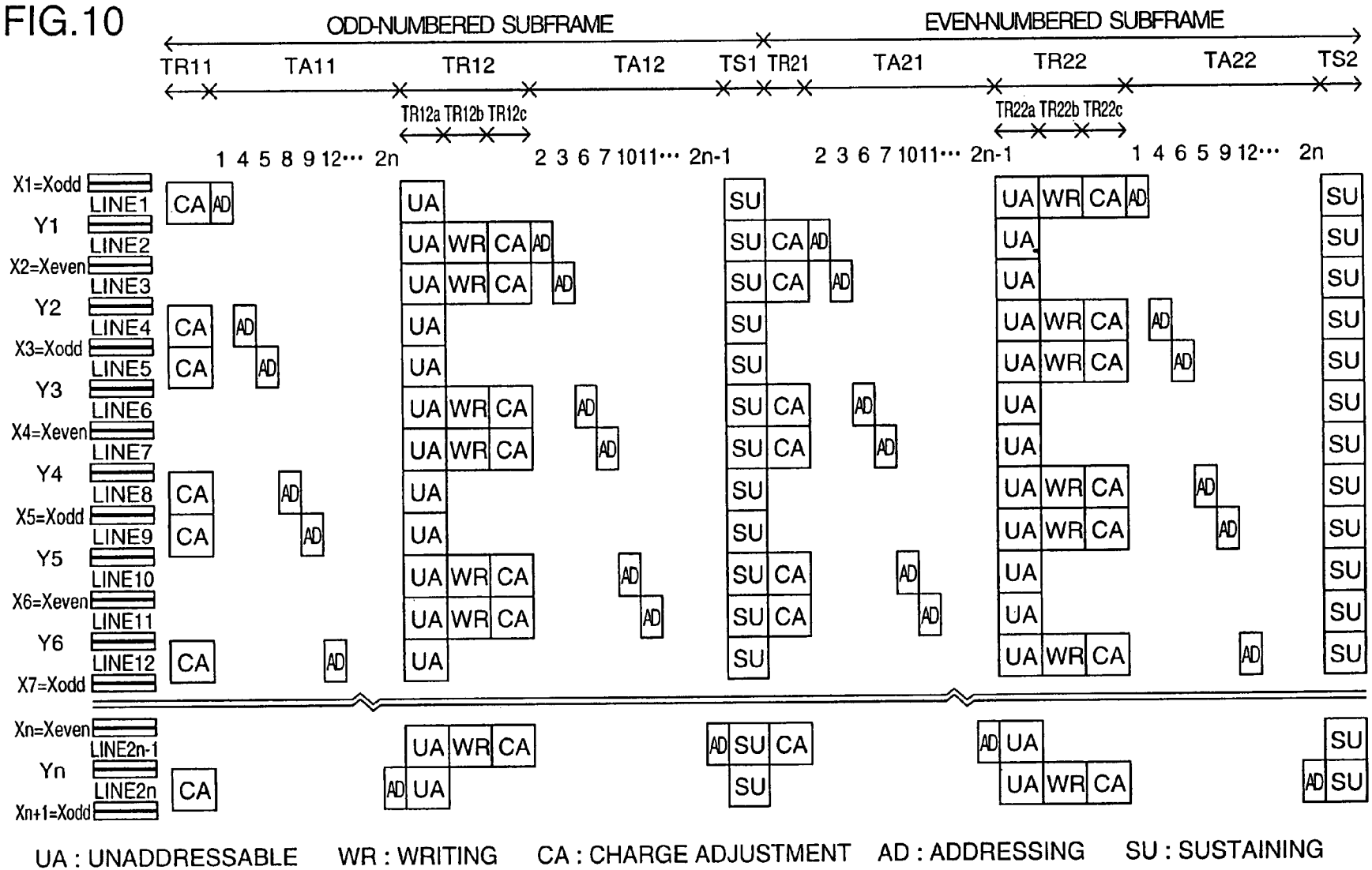
FIG. 10 is a view illustrating a detailed sequence according to the second embodiment of the present invention.

The detailed sequence of the second embodiment is shown in FIG. 10. As mentioned above, odd-numbered subframes and even-numbered subframes are alternately repeated in the sequence of the second embodiment.

In the above explanation of the second embodiment the second reset period TR12 of the odd-numbered subframe is described to have two sequences of the first step TR12*a* and the second step TR12*b*. In further detail the second step TR12*b* is divided into two sequences of Write and Charge adjustment. Accordingly, hereinafter the second reset period TR12 of the odd-numbered subframe is consisted of the first step TR12*a*, the second step TR12*b* and the third step TR12*c*.

The second reset period TR22 of the even-numbered subframe is also described to have two sequences of the first step TR22*a* and the second step TR22*b*, but in further detail, the second step TR22*b* is consisted of two sequences of Write and Charge adjustment. Hereinafter the second reset period TR22 of the even-numbered subframe is consisted of the first step TR22*a*, the second step TR22*b* and the third step of TR22*c*.

Each of the subframes has the same sequence as that of the first embodiment except that the first step TR1*a* and the second step TR1*b* of the first reset period TR1 are omitted. In the odd-numbered subframe the display lines using the Xodd electrodes are addressed in the first address period TA11 and the display lines using the Xeven electrodes are addressed in the second address period TA12, whereas in the even-numbered subframe the display lines using the Xeven electrodes and those using the Xodd electrodes are addressed in the first address period TA21 and the second address period TA22, respectively. This is the difference between the odd-numbered subframe and the even-numbered subframe.

Under such sequence, the display lines addressed in the second address period will be addressed in the first address period in the subsequent subframe. At this time, the operation of producing the unaddressable state and writing in the first reset periods TR11 and TR21 can be omitted. The reason is described below.

The reason why the first reset period TR21 of the even-numbered subframe includes the charge adjustment only is explained below.

The display lines using the Xodd electrodes need to be in the unaddressable state in the first address period TA21 of the even-numbered subframe. Here, if the address discharge is not produced in the first address period TA11 of the odd-numbered subframe, the display lines are turned to be in the unaddressable state in the first step TR12*a* of the second reset period TR12 and do not react thereafter. Accordingly the first reset period in the subsequent even-numbered subframe is unnecessary. Further, where the address discharge is generated in the second address period TA12 of the odd-numbered subframe, the discharge occurs in the sustain period TS1. However, by terminating the discharge in the sustain period in an unaddressable state (X electrodes are ended in a positive state), the first reset period can be omitted.

Further, the display lines using the Xeven electrodes need to be addressable in the first address period TA21 of the even-numbered subframe. Here, if the address discharge is not generated in the second address period TA12 in the odd-numbered subframe (therefore no discharge occurs in the sustain period), the addressable state is maintained and thus the first reset period of the subsequent even-numbered subframe is unnecessary. Further, where the address discharge is produced in the second address period TA12 of the odd-numbered subframe (therefore discharge occurs in the sustain period), the display lines are turned to be in the addressable state by merely adjusting the charges generated by the sustain discharge.

From the above, in the first reset period TR21 of the even-numbered subframe, only the charge adjustment is carried out. The same is applied to the first reset period TRl1 of the odd-numbered subframe. Thus, the sequences for producing the unaddressable state and writing are omitted from the first reset period of both of the even-numbered and odd-numbered subframes.

Figure 11:
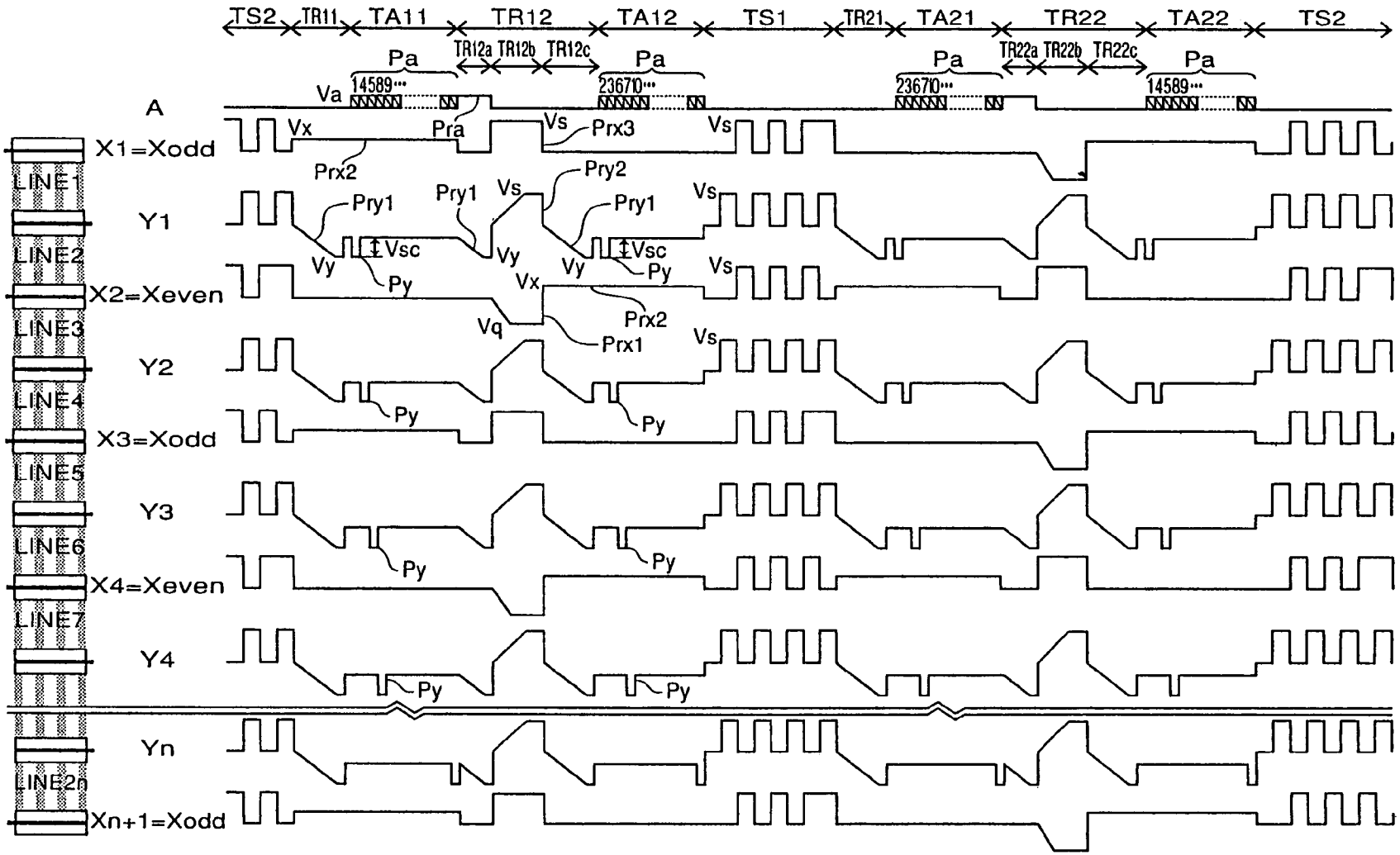
FIG. 11 is a view illustrating detailed driving waveforms according to the second embodiment of the present invention.

FIG. 11 shows the detailed driving waveforms. Different from the first embodiment, the first and second address periods are switched between the odd-numbered subframe and the even-numbered subframe and only the charge adjustment (TR1*c* in the first embodiment) is carried out in the first reset periods TR11 and TR21.

In the first reset period TR11 of the odd-numbered subframe, the pulse Prx2 is applied to the Xodd electrodes, 0V is applied to the Xeven electrodes, the pulse Pry1 is applied to the Y electrodes and 0V is applied to the A electrodes. In the display lines using the Xodd electrodes, charges generated during the sustain discharge in the preceding subframe are adjusted by the pulses Prx2 and Pry1 and turned to be addressable. The display lines using the Xeven electrodes are not reacted.

The first address period TA11 is the same as the first reset period TA1 of the first embodiment and in which the display lines using the Xodd electrodes are addressed.

The second reset period TR12 is the same as the second reset period TR2 of the first embodiment and in which only the Xeven electrodes are turned to be addressable.

The second address period TA12 is the same as the second address period TA2 of the first embodiment and in which the display lines using the Xeven electrodes are addressed.

In the sustain period TS1 the pulse Ps is alternately applied to the X electrodes and the Y electrodes in order to produce sustain discharge. At the end of the sustain period, the Xodd electrodes are ended in a positive state so that the display lines using the Xodd electrodes are not addressed in the first address period TA21 of the following subframe.

In the even-numbered subframe the operations performed with respect to the Xodd electrodes and the Xeven electrodes in the odd-numbered subframe are switched.

FIGS. 12(*a*) to 12(*d*) illustrate the third embodiment of the method of driving the PDP according to the present invention. FIGS. 12(*a*) to 12(*c*) are block diagrams showing voltage application in subframes A to C, respectively. The waveforms of the applied voltages in the subframes A to C are the same as those shown in the second embodiment. FIG. 12(*d*) shows subframes included in a single frame. The third embodiment is a combination of the first and second embodiments.

In general, the AC-PDP is controlled to display a single frame as a minimum unit of image display. One frame is formed of plural subframes. As mentioned above, a period for forming a single frame is defined. In many cases the period is about 16.7 msec (1/60 sec). However, a period for a single subframe is not determined because the number of pulses for display discharge needs to be changed in order to control electric power.

Accordingly, a blank period exists in a single frame in addition to the subframes. Since the driving method according to the second embodiment utilizes the charges accumulated in the preceding subframe, the operation does not proceed correctly if an error occurs between the subframes. Therefore, if the blank period lies between the subframes, erroneous operation may possibly be caused due to extinction of the charges or the like.

Considering this point, the third embodiment utilizes the subframes of three types. The subframe A shown in FIG. 12(*a*) shows the same voltage waveform as that of the first embodiment. The subframes B and C shown in FIGS. 12(*b*) and 12(*c*), respectively, show the same voltage waveforms as those of the second embodiment.

As shown in FIG. 12(*d*), the subframe A comes first in a single frame. The subframe A always functions regularly regardless of the charge state in the preceding subframe. The subframes B and C alternately follow the subframe A. The blank period in the frame lies in the end of the frame. Even if the erroneous discharge occurs in the blank period, this is not problematic since the subframe A follows the blank period.

In the present embodiment, highly reliable driving is realized because the operation is regularly carried out even if an error occurs in the blank period in the frame. In the second embodiment, the number of subframes in a single frame is defined to be an even number if the waveforms of every frame are the same. That is, where the number of subframes in a single frame is an odd number, it means that the subframe B or C is repeated in one frame and causes malfunction. However, the third embodiment is free from such a problem.

Figure 13:
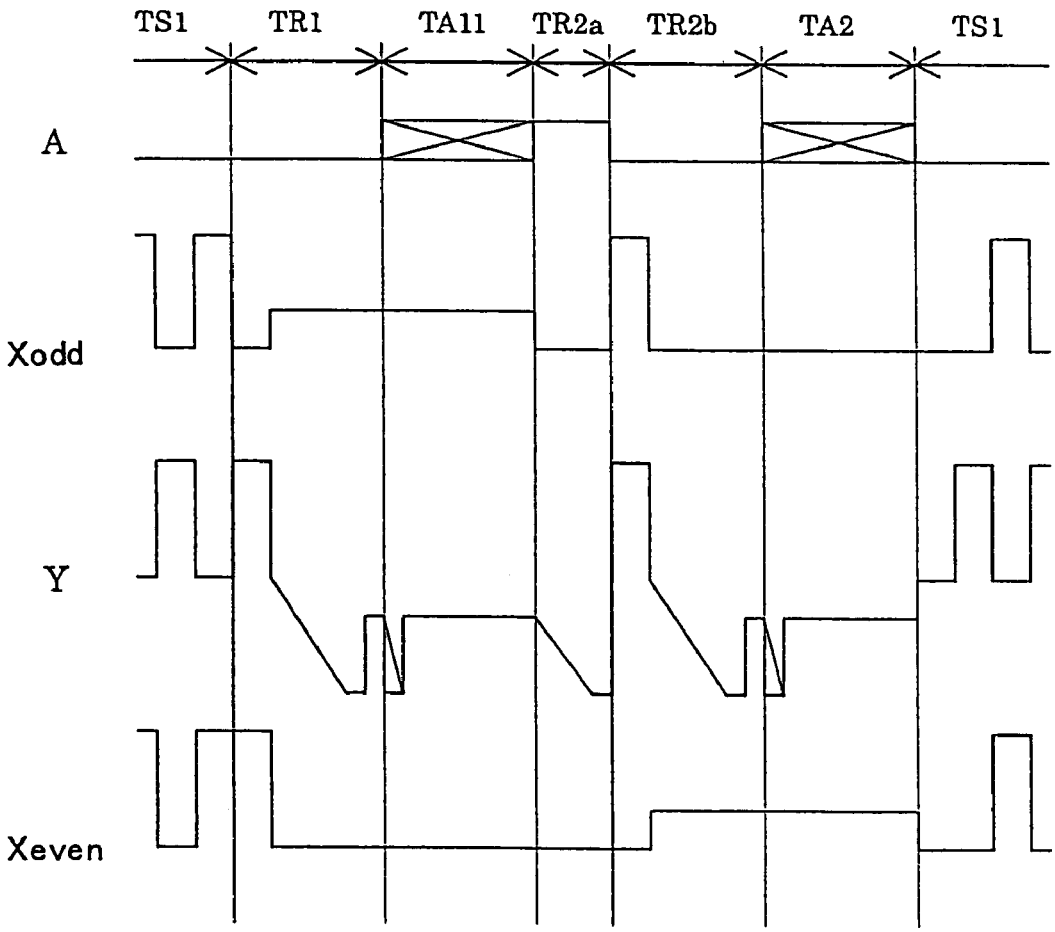
FIG. 13 is a view illustrating waveforms of applied voltages according to the fourth embodiment of the present invention.

FIG. 13 illustrates waveforms of applied voltages of the fourth embodiment of the method of driving the PDP according to the present invention.

The fourth embodiment is a variation of the second embodiment. The initialization in the first half is simplified in the second embodiment, whereas the initialization in the second half is also simplified in the fourth embodiment. If the initialization in the second half is simplified, cells that were not discharged in the preceding subframe are not driven but those discharged in the preceding subframe can be driven.

The first half of the fourth embodiment is the same as that of the second embodiment. In the second half, only the charge adjustment is carried out in the second step TR2*b* in the second reset period. That is, according to the charge adjustment, wall voltage generated between the A electrodes and the Y electrodes are adjusted to be not less than a value obtained by reducing a voltage applied between the A and Y electrodes at the addressing from a voltage at the beginning of the discharge between the A and Y electrodes. Further, wall voltage generated between the X and Y electrodes is adjusted to be not greater than a value obtained by reducing a voltage applied between the X and Y electrodes at the display discharge from a voltage at the beginning of the discharge between the X and Y electrodes.

According to the charge adjustment, only the cells illuminated in the preceding subframe are turned to be addressable. Since the cells not discharged in the preceding subframe are not reacted, the background illumination does not occur and the period is reduced as compared with the second embodiment.

Figure 14:
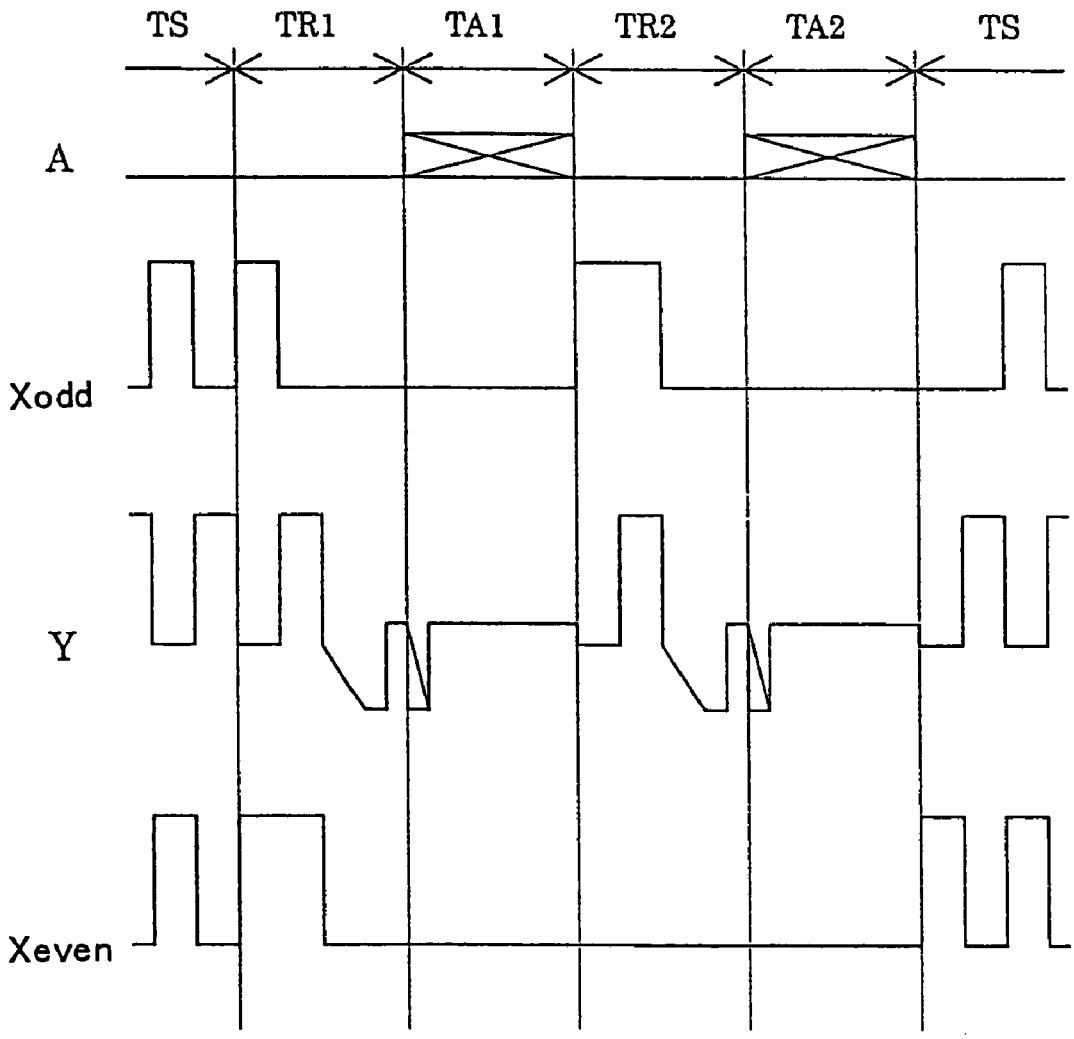
FIG. 14 is a view illustrating waveforms of applied voltages according to the fifth embodiment of the present invention.

FIG. 14 shows waveforms of voltages applied in the fifth embodiment of the method of driving the PDP according to the present invention.

The fifth embodiment is a variation of the fourth embodiment. The fourth embodiment utilizes the write driving mode, whereas the fifth embodiment is related to the forth embodiment in the erase driving mode. Under the erase driving mode, the pulse in the second reset period in the second half of the fourth embodiment is substituted with a reverse pulse.

The first half of the fifth embodiment is substantially the same as that of the second embodiment. However, a scan voltage is defined lower since erase driving is carried out. In the second half the first step TR2*a* and the second step TR2*b* in the second reset period of the forth embodiment are omitted and the reverse pulse is applied in the second reset period TR2 shown in FIG. 14.

In the second reset period TR2, the polarity is reversed between the Xodd and Y electrodes so that the cells addressable in the first half are turned to be unaddressable in the second half, and the cells unaddressable in the first half are turned to be addressable in the second half.

Similar to the fourth embodiment, the fifth embodiment also allows to address only the cells discharged in the preceding subframe. Further, even if it is operated in the erase driving mode, it is advantageous in that the background illumination is not generated and the period is reduced as compared with the fourth embodiment.

FIGS. 15(*a*) to 15(*f*) illustrate the sixth embodiment of the method of driving the PDP according to the present invention. FIGS. 15(*a*) to 15(*e*) are block diagrams each showing voltage application pattern in subframes A to E, and FIG. 15(*f*) shows the details of the subframes.

The sixth embodiment is a combination of the third, fourth and fifth embodiments. The voltage application patterns of the subframes A to C are the same as those shown in the third embodiment. The voltage application patterns of the subframes D and E are the same as those shown in the fourth and fifth embodiments, respectively.

The above mentioned embodiment is applicable to the following case. As described above, the gradation driving of the AC-PDP is generally carried out by forming a single frame with subframes having weighted luminance. For example, if the luminance is weighted by a power of 2 (1, 2, 4, 8 . . . ), gradation of 256 levels is realized with 8 subframes.

With such a simple arrangement of the subframes, however, a problem of a dummy outline occurs. To deal with the problem, the number of subframes is increased to divide the luminance weight. Here, the subframes having the luminance of the same weight may successively be arranged. In such a case, since there is a subframe which illuminates the cell only when the cell was illuminated in the preceding subframe, the voltage application pattern of the fourth or fifth embodiment is utilized.

For example, if subframes (SF1 to SF12) with weighted luminance are arranged as shown in FIG. 15(*f*), the voltage application pattern of the subframe D or E can be applied to the subframes 7 and 8 (SF7 and SF8).

The voltage applications pattern can also be applied to the subframe 6. However, in view of the problem of the dummy outline, it is preferable that the subframe 6 can be illuminated independently. Accordingly, in this embodiment, the subframe 6 utilizes the voltage application pattern of the subframe B. After the voltage application pattern of the subframe D or E is used for the subframes 7 and 8, the voltage application pattern of the subframe A is applied to the subframe 9 (SF9) because the subframe 9 needs to be driven independently without any influence from the preceding subframe.

Thus, one of the two display lines utilizing the same scan electrode is turned to be addressable and the other is turned to be unaddressable, and then the addressing is carried out. Thereby the progressive mode driving of the ALiS type PDP is allowed while ensuring sufficient driving margin. Further, display with much higher quality is realized with low background luminance.

According to the present invention, the progressive display is realized in the PDP wherein two adjacent display lines utilize a single scan electrode.

What is claimed is:

1. A method of driving a plasma display panel having a plurality of display electrodes and a plurality of address electrodes arranged orthogonally to each other between a pair of substrates defining a discharge space therebetween, adjacent display electrodes defining respective display lines therebetween by corresponding surface discharge, cells being defined at positions of intersections of the display lines and the address electrodes, a respective, single display electrode between two adjacent first and second display lines being utilized as a scan electrode at the time of producing an address discharge to select a cell to illuminate, the method comprising:

forming a wall voltage of a charge state between a portion of the scan electrode on the first display line side and the display electrode adjacent to the first display line, such that a discharge is not generated during an address period, while forming a wall voltage of a charge state between a portion of the scan electrode on the second display line side and the display electrode adjacent to the second display line, so as to generate an address discharge in the second display line;

forming a wall voltage of a charge state between the portion of the scan electrode on the second display line side and the display electrode adjacent to the second display line, such that a discharge is not generated during an address period, while forming a wall voltage of a charge state between the portion of the scan electrode on the first display line side and the display electrode adjacent to the first display line so as to generate an address discharge in the first display line; and generating surface discharges simultaneously in the first and second display lines, thereby to achieve progressive display.

2. A method of driving a plasma display panel having a plurality of display electrodes and a plurality of address electrodes arranged orthogonally to each other between a pair of substrates defining a discharge space therebetween, adjacent display electrodes defining respective display lines therebetween by corresponding surface discharge, cells being defined at positions of intersections of the display lines and the address electrodes, a respective, single display electrode between two adjacent display lines being utilized as a scan electrode at the time of producing an address discharge to select a cell to illuminate, the method comprising:

forming a single frame with a plurality of subframes and defining, in each of the subframes, an address period for generating address discharges between the address electrode and every other display electrode used as the scan electrode and a display period for generating surface discharge between the display electrodes;

dividing display electrodes that are not used as the scan electrode into a first group and a second group, depending on whether they are odd-numbered or even-numbered, respectively;

forming, in a first half of the address period, a wall voltage of a charge state between a portion of the scan electrode on the display line side using one of the first and second group display electrodes and said display electrode, such that an address discharge is not generated, while forming a wall voltage of a charge state in the display line using the display electrode of the other group, so as to generate address discharges progressively in the display lines using the display electrodes of the other group;

forming, subsequently in a second half of the address period, a wall voltage of a charge state between a portion of the scan electrode on the display line side using the display electrode of the other group and said display electrode, such that an address discharge is not generated, while forming a wall voltage of a charge state in the display line using said one of the first and second group display electrodes, so as to generate address discharges progressively in the display lines using the display electrodes of said one of the first and second groups; and generating surface discharges in all the display lines simultaneously in the display period, thereby to achieve progressive display.

3. A method of driving a plasma display panel having a plurality of display electrodes and a plurality of address electrodes intersecting with each other between a pair of substrates defining a discharge space therebetween, adjacent display electrodes defining respective display lines therebetween by corresponding surface discharge, cells being defined at positions of intersections of the display lines and the address electrodes, a respective, single display electrode between two adjacent display lines being utilized as a scan electrode at the time of producing an address discharge to select a cell to illuminate, the method comprising:

forming a single frame with a plurality of subframes and defining, in each of the subframes, an address period for generating address discharges between the address electrode and every other display electrode used as the scan electrode and a display period for generating surface discharges between the display electrodes;

dividing the display electrodes that are not used as the scan electrode into a first group and a second group, depending on whether they are odd-numbered or even-numbered, respectively;

dividing the address period into a first half address period for addressing first group display lines defined between the first group display electrodes and the scan electrodes adjacent to the first group display electrodes, and a second half address period for addressing second group display lines defined between the second group display electrodes and the scan electrodes adjacent to the second group display electrodes;

applying a voltage, prior to progressive scanning of the scan electrodes, controlling the respective charge states of the wall voltages formed between the electrodes of the first group display lines and the electrodes of the second group display lines in each address period so that the respective charge states are in different levels from each other; and generating surface discharges in all the display lines in the display period after completion of both the first half and the second half address periods, thereby to achieve a display in each subframe.

4. A method according to claim 3, wherein, in a first half of each subframe, the control of the charge states prior to the scanning in the first half address period or the even-numbered address period is performed by adjusting walls charges in a cell illuminated in a display period of a preceding subframe to voltages of charge states, such that an address discharge can be generated between the scan electrode and the address electrode and a surface discharge is not generated between the display electrodes.

5. A method according to claim 4, wherein, in a second half of each subframe, the control of the charge states prior to the scanning in the second half address period is performed by reversing polarity of wall charges on the scan electrode.

6. A method according to claim 3, wherein, prior to the scanning in the first half or the second half address period in a first or second half of each subframe, a voltage pulse having the same polarity as a voltage pulse for generating an address discharge is applied between the address electrode and the scan electrode, thereby to control a charge state of all the display lines to a voltage such that an address discharge is not generated.

7. A method according to claim 3, wherein a subframe, in which an address discharge is generated on the first group display lines using a display electrode of the first group in the first half of the address period and then an address discharge is generated on the second group display lines using a display electrode of the second group in the second half of the address period, and a subframe, in which an address discharge is generated on the even-numbered display lines using the display electrode of the second group in the first half of the address period and then an address discharge is generated on the second group display lines using the display electrode of the first group in the second half of the address period, are repeated alternately in a period of a single frame.

8. A method according to claim 3, wherein a subframe for generating an address discharge only in a cell, in which a display discharge is carried out in a preceding subframe, is included in a period of a single frame.

9. A method according to claim 3, wherein a subframe, for generating an address discharge for forming electric charges, and a subframe, for generating address discharge for erasing the electric charges, coexist in a period of a single frame.

10. A method according to claim 9, wherein a voltage, applied to generate an address discharge for forming electric charges, and a voltage, applied to generate an address discharge for erasing the electric charges, are different.

11. A method according to claim 3, wherein, in a second half of each subframe, the control of the charge states prior to the scanning in the second half address period is performed by reversing polarity of wall charges on the scan electrode.

12. A method of driving a plasma display panel in which a plurality of scan electrodes and a plurality of display electrodes having their surfaces covered with a dielectric layer extend in a row direction and are alternately arranged, a plurality of address electrodes extend in a column direction to intersect the scan electrodes and display electrodes and define cells at positions of their intersections, first group display lines are defined between odd-numbered display electrodes and the scan electrodes adjacent to the odd-numbered display electrodes on both sides, and second group display lines are defined between even-numbered display electrodes and the scan electrodes adjacent to the even-numbered display electrodes on both sides, the method comprising:

resetting, by applying a voltage between the scan electrodes and the even-numbered display electrodes to adjust, prior to addressing of the first group display lines, voltages of wall charges formed on a surface of a portion of the dielectric layer on the second group display line side so that the voltages of the wall charges are made of different charge states from voltages of wall charges formed on a surface of a portion of the dielectric layer on the first group display line side, the resetting being performed so that address discharge on the second group display line side, by an addressing voltage applied between the scan electrode and the address electrode at the time of addressing, is prevented; and resetting, by applying a voltage between the scan electrodes and the odd-numbered display electrodes to adjust, prior to addressing of the second group display lines, voltages of wall charges formed on the surface of the portion of the dielectric layer on the first group display line side so that the voltages of the wall charges are made of different charge states from voltages of wall charges formed on the surface of the portion of the dielectric layer on the second group display line side, the resetting being performed so that an address discharge on the first group display line side, by an addressing voltage applied between the scan electrode and the address electrode at the time of addressing, is prevented, wherein, when one of said addressings of the first and the second group display lines is performed in a first half of an address period, a voltage applied in resetting prior to a second half of the address period has a polarity that does not cause the charge state, previously formed on the portion of the dielectric layer on the first or the second group display line side in the first half of the address period, to disappear; and surface discharges are simultaneously generated in the first and the second group display lines after the addressing in the first half and the second half of the address period are separately performed, thereby to achieve progressive display.

13. A method of driving a plasma display panel in which a plurality of scan electrodes and a plurality of display electrodes having their surfaces covered with a dielectric layer extend in a row direction and are alternately arranged, a plurality of address electrodes extend in a column direction so as to intersect the scan electrodes and display electrodes and define cells at positions of their intersections, first group display lines are defined between odd-numbered display electrodes and the scan electrodes adjacent to the odd-numbered display electrodes on both sides, and second group display lines are defined between even-numbered display electrodes and the scan electrodes adjacent to the even-numbered display electrodes on both sides, the method comprising:

resetting, by applying a voltage to adjust, prior to addressing of the first group display lines, voltages of wall charges formed on a surface of a portion of the dielectric layer on the first group display line side so that the voltages of the wall charges are made of a different charge state from voltages of wall charges formed on a surface of a portion of the dielectric layer on the second group display line side, the resetting being performed so that said wall charges formed on the first group display line side are added to an addressing voltage, applied between the scan electrode and the address electrode at the time of addressing, to generate an address discharge in the first group display line; and resetting, by applying a voltage to adjust, prior to addressing of the second group display lines, voltages of wall charges formed on a surface of a portion of the dielectric layer on the second group display line side so that the voltages of the wall charges are made of a different charge state from voltages of wall charges formed on a surface of a portion of the dielectric layer on the first group display line side, the resetting being performed so that said wall charges, formed on the second group display line side, are added to an addressing voltage, applied between the scan electrode and the address electrode at the time of addressing, to generate an address discharge in the second group display line, wherein, when one of said addressings of the first and the second group display lines is performed in a first half of an address period, a voltage applied in resetting prior to a second half of the address period has a polarity that does not cause the charge state, previously formed on the portion of the dielectric layer on the first or the second group display line side on the first half of the address period, to disappear; and surface discharges are simultaneously generated in the first and the second group display lines after the addressing in the first half and the second half of the address period are separately performed, thereby to achieve progressive display.

14. A method of driving a plasma display panel having a plurality of display electrodes and a plurality of address electrodes arranged orthogonally to each other between a pair of substrates defining a discharge space therebetween, respective display lines being defined between adjacent display electrodes by corresponding surface discharges, cells being defined at positions of intersections of the display lines and the address electrodes, a respective, single display electrode between two adjacent first and second display lines being utilized as a scan electrode at the time of producing an address discharge to select a cell to illuminate, the method comprising:

forming a wall voltage of a charge state between a portion of the scan electrode on the first display line side and the display electrode adjacent to the first display line, such that a discharge is not generated during an address period, while forming a wall voltage of a charge state between a portion of the scan electrode on the second display line side and the display electrode adjacent to the second display line such that an address discharge can be generated, so as to generate an address discharge in the second display line;

forming a wall voltage of a charge state between the portion of the scan electrode on the second display line side and the display electrode adjacent to the second display line, such that a discharge is not generated during an address period, while forming a wall voltage of a charge state between the portion of the scan electrode on the first display line side and the display electrode adjacent to the first display line, so as to generate an address discharge in the first display line; and generating surface discharges simultaneously in the first and second display lines, thereby to achieve progressive display.

15. A method of driving a plasma display panel having a plurality of display electrodes and a plurality of address electrodes arranged orthogonally to each other between a pair of substrates defining a discharge space therebetween, respective display lines being defined between adjacent display electrodes by corresponding surface discharges, cells being defined at positions of intersection of the display lines and the address electrodes, a respective, single display electrode between two adjacent display lines being utilized as a scan electrode at the time of producing an address discharge to select a cell to illuminate, the method comprising:

forming a single frame with a plurality of subframes and defining, in each of the subframes, an address period for generating address discharges between the address electrode and every other display electrode used as the scan electrode and a display period for generating surface discharge between the display electrodes;

dividing the display electrodes that are not used as the scan electrode into a first group and a second group, depending on whether they are odd-numbered or even-numbered, respectively;

forming, in a first half of the address period, a wall voltage of a charge state between a portion of the scan electrode on the display line side using one of the first and second group display electrodes and said display electrode, such that an address discharge is not generated, while forming a wall voltage of a charge state in the display line using the display electrode of the other group, so as to generate an address discharges progressively in the display lines using the display electrodes of the other group;

forming subsequently, in a second half of the address period, a wall voltage of a charge state between a portion of the scan electrode on the display line side using the display electrode of the other group and said display electrode, such that an address discharge is not generated, while forming a wall voltage of a charge state in the display line using said one of the first and second group display electrodes, such that an address discharge can be generated, so as to generate address discharges progressively in the display lines using the display electrodes of said one of the first and second groups; and generating surface discharges in all the display lines simultaneously in the display period, thereby to achieve progressive display.

16. A method of driving a plasma display panel having a plurality of display electrodes and a plurality of address electrodes intersecting with each other between a pair of substrates defining a discharge space therebetween, respective display lines being defined between adjacent display electrodes by corresponding surface discharges, cells being defined at positions of intersections of the display lines and the address electrodes, a respective, single display electrode between two adjacent display lines being utilized as a scan electrode at the time of producing an address discharge to select a cell to illuminate, the method comprising:

forming a single frame with a plurality of subframes and defining, in each of the subframes, an address period for generating address discharges between the address electrode and every other display electrode used as the scan electrode and a display period for generating surface discharges between the display electrodes;

dividing the display electrodes that are not used as the scan electrode into a first group and a second group, depending on whether they are odd-numbered or even-numbered, respectively;

dividing the address period into a first half address period for addressing first group display lines defined between the first group display electrodes and the scan electrodes adjacent to the first group display electrodes, and a second half address period for addressing second group display lines defined between the second group display electrodes and the scan electrodes adjacent to the second group display electrodes;

applying a voltage, prior to progressive scanning of the scan electrodes, controlling the respective charge states of the wall voltages formed between the electrodes of the first group display lines and the electrodes of the second group display lines in each address period so that the respective charge states are in different levels from each other; and generating surface discharges in all the display lines in the display period after completion of both the first half and the second half address periods, thereby to achieve a display in each subframe.

17. A method according to claim 16, wherein, in a first half of each subframe, the control of the charge states prior to the scanning in the first half address period is performed by adjusting wall charges in a cell illuminated in a display period of a preceding subframe to voltages of charge states, such that an address discharge can be generated between the scan electrode and the address electrode and a surface discharge is not generated between the display electrodes.

18. A method according to claim 16, wherein, prior to the scanning in the first half or the second half address period in a first or second half of each subframe, a voltage pulse having the same polarity as a voltage pulse for generating an address discharge is applied between the address electrode and the scan electrode, thereby to control a charge state of all the display lines to a voltage such that an address discharge is not generated.

19. A method of driving a plasma display panel in which a plurality of scan electrodes and a plurality of display electrodes having their surfaces covered with a dielectric layer extend in a row direction and are alternately arranged, a plurality of address electrodes extend in a column direction so as to intersect the scan electrodes and display electrodes and define cells at positions of their intersections, first group display lines are defined between odd-numbered display electrodes and the scan electrodes adjacent to the odd-numbered display electrodes on both sides, and second group display lines are defined between even-numbered display electrodes and the scan electrodes adjacent to the even-numbered display electrodes on both sides, the method comprising:

resetting by applying a voltage between the scan electrodes and the even-numbered display electrodes of the second group to adjust, prior to addressing of the first group display lines, voltages of wall charges formed on a surface of a portion of the dielectric layer on the second group display line side so that the voltages of the wall charges are made of different charge states from voltages of wall charges formed on a surface of a portion of the dielectric layer on the first group display line side, the resetting being performed so that address discharge on the second group display line side, by an addressing voltage applied between the scan electrode and the address electrode at the time of addressing, is prevented; and resetting by applying a voltage between the scan electrode and the odd-numbered display electrodes to adjust, prior to addressing of the second group display lines, voltages of wall charges formed on the surface of the portion of the dielectric layer on the first group display line side so that the voltages of the wall charges are made of different charge states from voltages of wall charges formed on the surface of the portion of the dielectric layer on the second group display line side, the resetting being performed so that an address discharge on the first group display line side, by an addressing voltage applied between the scan electrode and the address electrode at the time of addressing, is prevented, wherein, when one of said addressings of the first and the second group display lines is performed in a first half of an address period, a voltage applied in a resetting prior to a second half of the address period has a polarity that does not cause the charge state, previously formed on the portion of the dielectric layer on the first or the second group display line side in the first half of the address period, to disappear, and surface discharges are simultaneously generated in the first and the second group display lines after the addressing in the first half and the second half of the address period are separately performed, thereby to achieve progressive display.

20. A method of driving a plasma display panel in which a plurality of scan electrodes and a plurality of display electrodes having their surfaces covered with a dielectric layer extend in a row direction and are alternately arranged, a plurality of address electrodes extend in a column direction so as to intersect the scan electrodes and display electrodes and define cells at positions of their intersections, first group display lines are defined between odd-numbered display electrodes and the scan electrodes adjacent to the odd-numbered display electrodes on both sides, and second group display lines are defined between even-numbered display electrodes and the scan electrodes adjacent to the even-numbered display electrodes on both sides, the method comprising:

resetting by applying a voltage to adjust, prior to addressing of the first group display lines, voltages of wall charges formed on a surface of a portion of the dielectric layer on the first group display line side so that the voltages of the wall charges are made of a different charge state from voltages of wall charges formed on a surface of a portion of the dielectric layer on the second group display line side, the resetting being performed so that said wall charges formed on the first group display line side are added to an addressing voltage, applied between the scan electrode and the address electrode at the time of addressing, to generate an address discharge in the first group display line; and resetting by applying a voltage to adjust, prior to addressing of the second group display lines, voltages of wall charges formed on a surface of a portion of the dielectric layer on the second group display line side so that the voltages of the wall charges are made of a different charge state from voltages of wall charges formed on a surface of a portion of the dielectric layer on the first group the odd-numbered display line side, the resetting being performed so that said wall charges, formed on the second group display line side, are added to an addressing voltage, applied between the scan electrode and the address electrode at the time of addressing, to generate an address discharge in the second group display line, wherein, when one of said addressings of the first and the second group display lines is performed in a first half of an address period, a voltage applied in resetting prior to a second half of the address period has a polarity that does not cause the charge state, previously formed on the portion of the dielectric layer on the first or the second group display line side on the first half of the address period, to disappear; and surface discharges are simultaneously generated in the first and the second group display lines after the addressing in the first half and the second half of the address period are separately performed, thereby to achieve progressive display.

* * * * *